United States Patent [19]

Eddy

[11] 4,259,372

[45] Mar. 31, 1981

[54] METHOD AND APPARATUS FOR APPLYING SEALANT TO A SEAM IN A CONTAINER

[75] Inventor: William R. Eddy, Kansas City, Mo.

[73] Assignee: Phillips Petroleum Company, Bartlesville, Okla.

[21] Appl. No.: 924,328

[22] Filed: Jul. 13, 1978

[51] Int. Cl.[3] ..... B05B 13/06; B05B 15/02; B05D 7/22

[52] U.S. Cl. ..... 427/236; 15/256.5; 118/302; 118/317; 156/218; 156/389; 156/578; 239/115; 427/422

[58] Field of Search ..... 156/578, 548, 218, 389; 118/302, 306, 317; 239/106, 114, 115, 123, 122; 15/256.5; 427/230, 236, 422

[56] References Cited

U.S. PATENT DOCUMENTS

| | | | |
|---|---|---|---|
| 2,884,895 | 5/1959 | Lopenski et al. | 118/302 |
| 2,899,929 | 8/1959 | Monroe | 118/302 |
| 3,457,131 | 7/1969 | Rosenstein | 156/578 |
| 3,876,144 | 4/1975 | Madden et al. | 118/302 X |
| 4,016,024 | 4/1977 | Karlsson | 156/578 X |
| 4,132,357 | 1/1979 | Blackinton | 118/302 X |

*Primary Examiner*—Michael G. Wityshyn

[57] ABSTRACT

An apparatus for applying sealant to a selected area of a container.The apparatus includes means for conveying a container into and away from a sealant applying station. Sealant dispensing means is positioned adjacent the conveying means at the sealing station and is operable for dispensing sealant onto a selected area of the container. Means is provided adjacent the sealant dispensing means for selectively removing any excess sealant from a nozzle portion of the sealant dispensing means.

21 Claims, 14 Drawing Figures

METHOD AND APPARATUS FOR APPLYING SEALANT TO A SEAM IN A CONTAINER

The present invention relates to an apparatus for processing containers by applying sealant to a selected area of a container or the like.

In the manufacture of tubular sidewall containers from a blank, portions of the blank are overlapped and secured together to form the sidewall. A bottom member is secured to the sidewall to form the bottom of the container. Many methods are known in the art for producing such containers, for example U.S. Pat. Nos. 4,070,953 and 4,072,226 disclose apparatus and method for forming containers having a tubular sidewall.

Generally, such containers are manufactured from paperboard which can be treated on the surface or throughout the thickness with the material to make the paperboard leak-proof for use in containers when the migration of moisture through the container would be detrimental. Typically, paperboard which is used to form such containers has a coating of polyethylene on both the interior and exterior surfaces to form a moisture barrier. This, though, leaves the edges of the paperboard susceptible to the passage of liquid into the paperboard through the edge. Numerous methods have been devised to solve this problem, one of which is applying a sealant to the seams at the edge to form a liquid-proof barrier.

Another problem attendant with the formation of such containers is that during the formation of the seams, an incomplete seam may be formed. In the case of polyethylene coated or other thermoplastic material coated paperboard, seams are formed by applying heat and pressure to the seam to fuse the coating together between the overlapping portions. If an improperly formed seam is made, leakage can result through the seam area.

To overcome the leakage problem at the seams, sealant has been applied in the area of the seams to form a barrier. The application of sealant has been successful, both from a functional standpoint and an economic standpoint, to solve the leakage problem. However, in the past there have been problems with the application of sealant to the side seam which extends generally longitudinally of the container at the overlapping portions of the sidewall. Some methods of overcoming the problem have been the use of tape on the seam, coating the entire interior surface of the container, and dipping the edge of the blank in sealant. However, all these methods have been costly, both in production time and cost. Sealing of the bottom seam, however, is a relatively simple process in which sealant is sprayed directly onto the seam while the container is being rotated relative to the dispensing nozzle.

The present invention provides means for use with a container processing apparatus utilized for applying sealant to a selected area of the container. When applying sealant to a container or the like, a problem has been encountered with the dispensing of sealant. After the sealant has been dispensed, there has been a tendency with certain nozzle designs and with certain sealant for the sealant to continue to be dispensed from the nozzle leaving a minor amount of sealant on the end of the nozzle. This excess sealant has had a tendency to effect subsequent dispensing of sealant and cause a bad bead of sealant to be formed. The present invention provides means for removing this sealant and obviating the problems attendant with the leakage of sealant after dispensing has been terminated.

An object of the present invention is to provide an apparatus for processing containers by applying sealent to a selected area of the container. Another object of the present invention is to provide means for use with a container processing apparatus which will remove any excess sealant leaks after dispensing of the sealant has been terminated. Another object of the present invention is to provide means for removing excess sealant from a dispensing nozzle which is well adapted for its intended use, economical to manufacture, simple to maintain and well adapted for its intended use.

Other objects and advantages of the present invention will become apparent from the following detailed description taken in connection with the accompanying drawings wherein are set forth by way of illustration and example, certain embodiments of this invention.

Figure 12A:
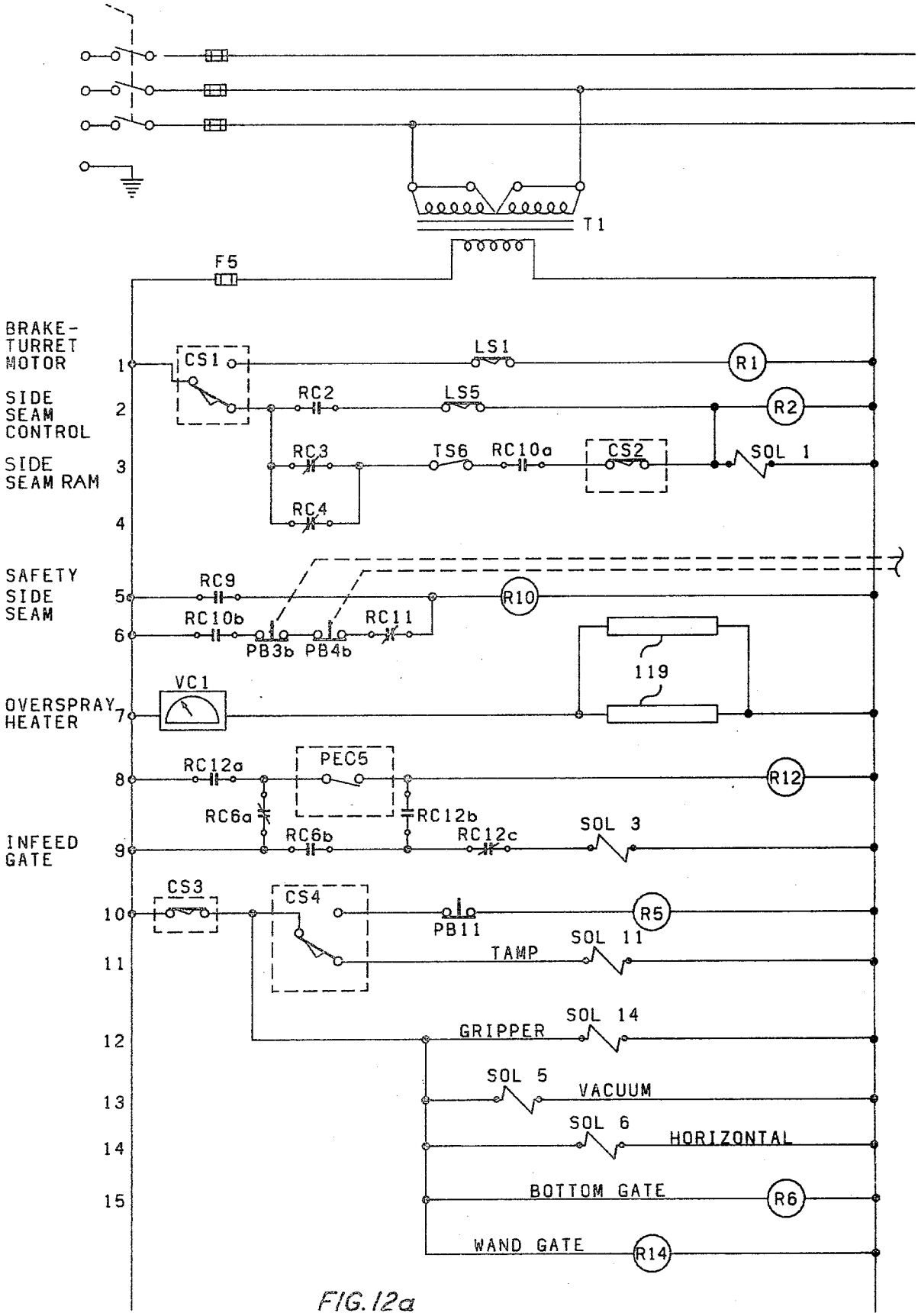
Figure 12B:
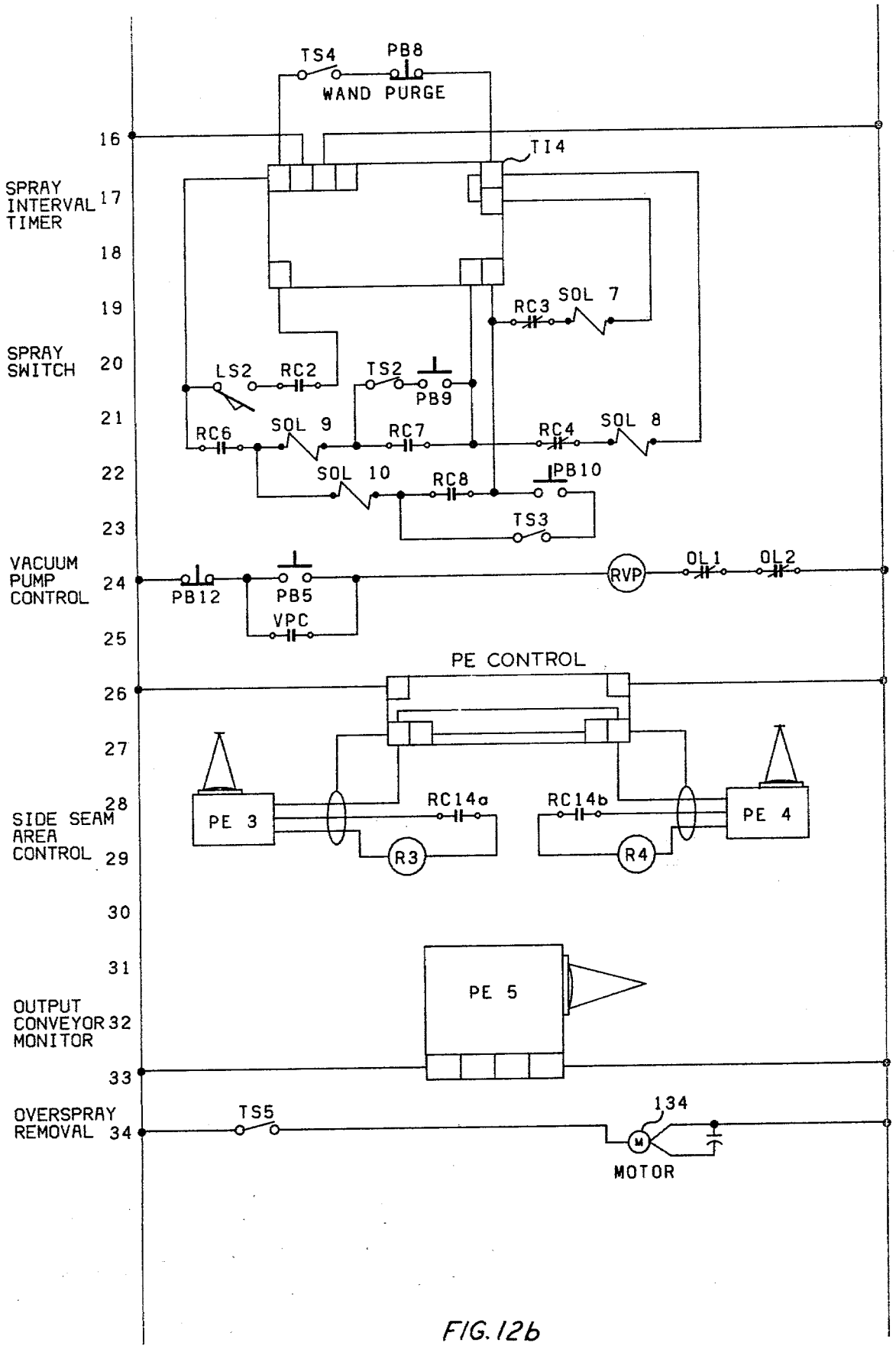
Figure 12C:
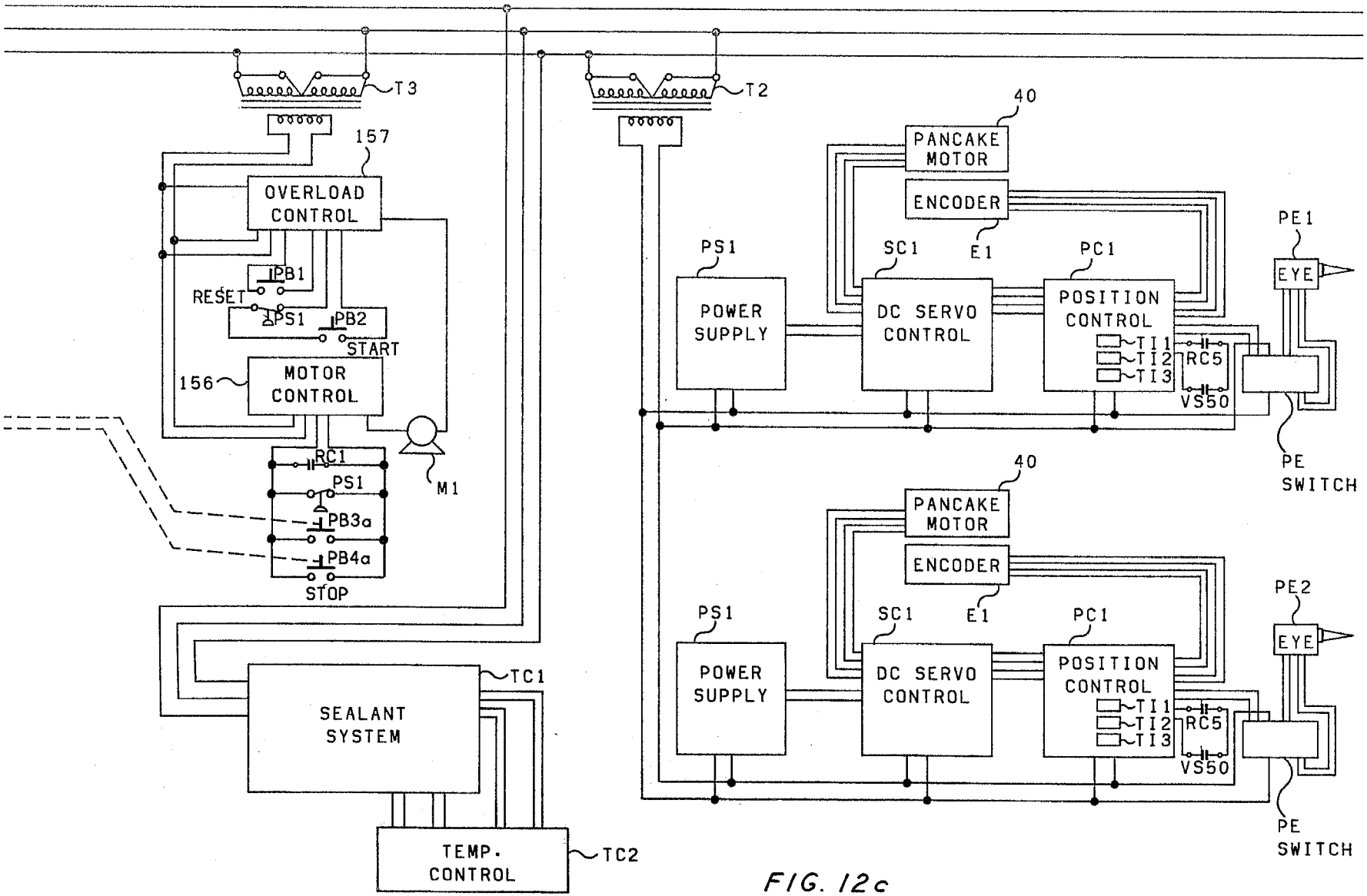

FIGS. 12*a*, 12*b* and 12*c* are a schematic diagram of a control system for the container processing apparatus.

Referring more in detail to the drawings:

The reference numeral 1 designates generally an apparatus for applying a material such as sealant to a selected area of a container or the like. The apparatus 1 includes conveying means 2 adapted for feeding containers first to an orienting station 3 operable for orienting a container to a predetermined rotational position. Either at the orienting station 3 or at another station, means 4 is provided for applying sealant or the like to a preselected area, preferably the side seam of a container. The conveying means 2 then moves the container after the application of sealant to a discharge conveyor means 5 for discharge of the container from the apparatus 1. In the illustrated structure, the conveying means 2 includes a feed conveyor means 7 operable for feeding containers from a source to a rotatable turret 8 portion of the conveying means 2.

The conveyor 7 can be of any suitable type such as an endless belt or chain. Preferably, the conveyor 7, as illustrated, includes two conveyor portions in side-by-side relation for feeding a pair of rows of containers from a source to the turret 8. A container feed control means 10 is positioned adjacent the turret 8 and is operable for selectively permitting containers on the conveyor 7 to be fed to the turret 8, one at a time in each row from each of the conveyor portions of the conveyor 7. The means 10 as illustrated includes gate-forming members 11 pivotally mounted on a support 12 which is positioned between the conveyor portions of the conveyor 7. Each of the gate members 11 has a link 14 pivotally connected thereto with the links 14 also being pivotally connected to a movable rod portion of a pneumatic ram 15 or the like. The ram 15 as illustrated is also mounted on the support 12. Control means, described hereinbelow, is operably connected to the ram 15 to sequence the operation thereof relative to the operation of the other portions of the apparatus 1. In operation, extension of the ram 15 effects pivoting movement of each of the gate members 11 about their pivot points such that the gate members project into the paths of the containers moving along the respective conveyor portion of the conveyor 7 to selectively prevent feeding of the containers 6 to the turret 8. At a preselected time, relative to the operation of the remainder of the apparatus 1, the ram 15 is retracted moving the gate members 11 out of their respective container movement paths allowing the conveyor portion of the conveyor 7 to move a respective container to the turret 8.

The turret 8 is rotatably mounted on the frame 17 of the apparatus 1. The turret 8 in the illustrated structure is comprised of a generally circular disc having a plurality of container receiving notches 18 therein with the notches 18 being circumferentially spaced apart and opening out of the periphery of the turret 8. The turret 8 is operably connected via drive means (not shown) to an indexing drive unit such as a Ferguson Intermittor S/2-FM75-120 manufactured by Ferguson Machine Co., Division of UMC Industries. The indexing drive is operable for sequentially or incrementally rotating the turret 8 in timed sequence to the operation of the other portions of the apparatus 1. The control of the operation of the indexing unit is described hereinbelow in the description of the control system. A support plate 9 is positioned beneath the turret 8 and supports containers 6 when being moved by the turret 8.

In order to help stabilize the containers being fed to the turret 8, an arm 72 is mounted on the apparatus 1 at a position for engaging an upper portion of the containers 6 on the conveyors of the conveyor 7. This helps prevent the containers from tipping during feeding into the respective notches 18. The arm 72, as illustrated, is mounted on the same support as ram 36 and is arcuately shaped extending from the support to a container engaging position adjacent the conveyor 7.

At each of the notches 18, there is provided clamp means 19 which is operable for selectively gripping a container in each of the notches 18 and releasably retaining the respective container in the respective notch 18. Any suitable gripping means 19 can be provided and, as illustrated, each of the gripping means 19 is similar in construction and operation. Because the clamp means 19 are similar, the description of only one clamp means need be provided. The clamp means 19 includes a pair of gripping members 20 and 21 having respective arms 22 and 23 pivotally mounted on the turret 8. Secured to each of the arms 22 and 23 is a gear 24 and 25, respectively, which are meshed together. Alternate arms 23, as illustrated, have a respective portion 23*a*, which is upwardly projecting or 23*b*, extending beyond its pivotal mount toward the center of rotation of the turret 8 which is downwardly projecting, each having a cam follower 26 mounted thereon. Means is provided for biasing the grippers 20 and 21 to a gripping position and in the illustrated structure the means is a resilient member 27 connected to each arm of the respective pair of arms 22 and 23. Preferably, the resilient member 27 is a coil spring.

Figure 4:
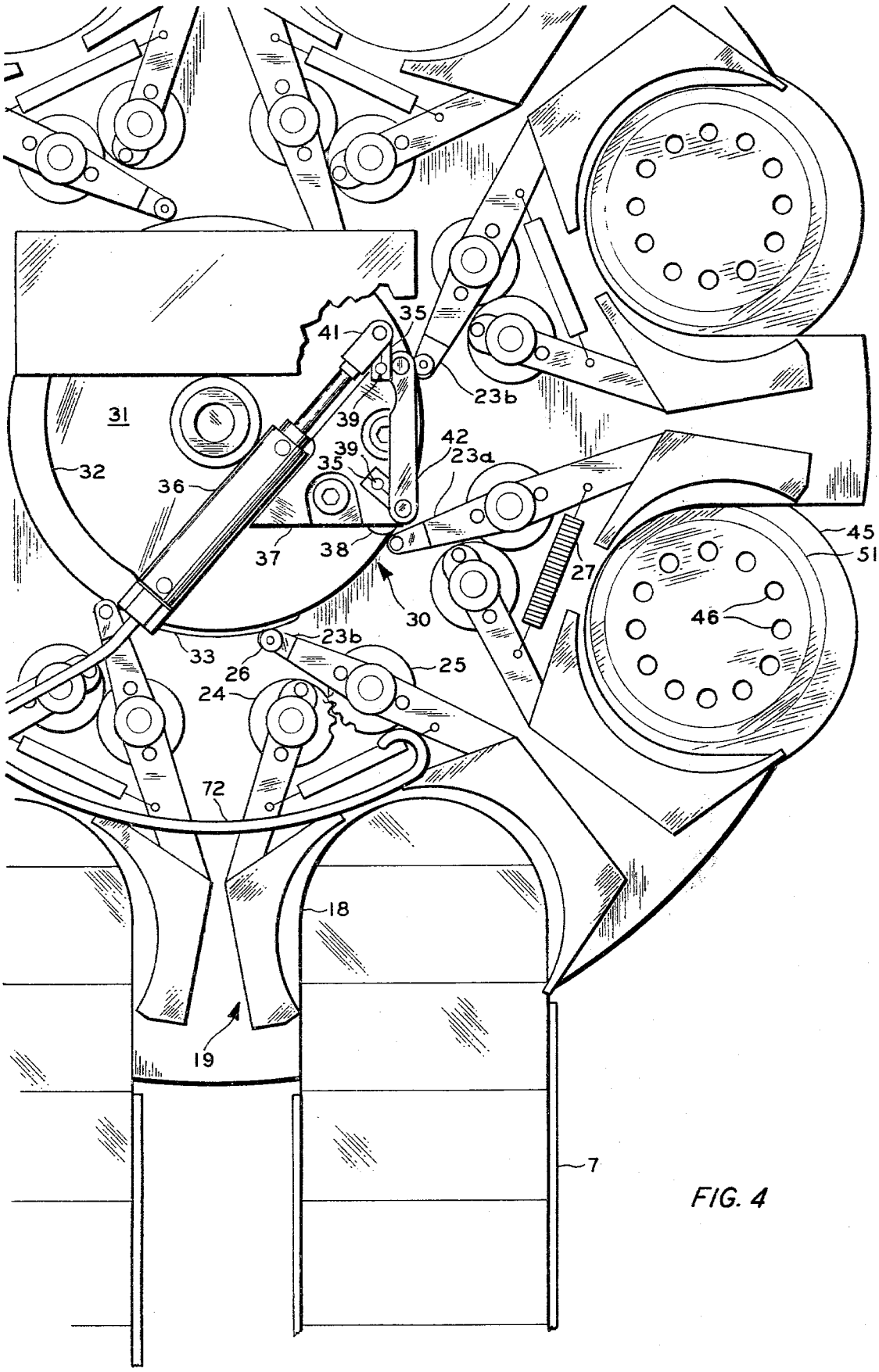
FIG. 4 is an enlarged fragmentary plan view of a portion of a turret-type conveyor.

The gripper means 19 is in the open position when positioned at the conveyor 7 and at the conveyor 5 and means is provided for selectively urging the gripping means 19 to the open position. Cam means 30 is mounted above the turret 8 and preferably is stationary during rotation of the turret 8. The cam means 30 in the illustrated structure is comprised of a central disc 31 which has secured thereto a first cam member 32 mounted on top of the disc 31 and a second cam member 33 mounted on the underneath side of the disc 31, as best seen in FIG. 4. Every other one of the arms 23 has the follower 26 mounted on the underneath side of the upward projection 23*a* of the arm 23 while the alternate arm 23 has the follower mounted on the top side of a downward projection 23*b* of the arm 23. For example, the arm 23 at the left hand conveyor of the conveyor 7 as viewed in FIG. 4 has the follower mounted on the underneath side of the arm 23 and the arm 23 adjacent the right hand conveyor of the conveyor 7 has follower mounted on the top side of the arm 23. The followers 26 on the bottom side will engage the cam 32 while the followers 26 on the top side will engage the cam 33, thereby allowing simultaneous pivoting movement of the arms 23 at either the conveyor 5 or conveyor 7. The cams 32 and 33 are contoured such that the gripping means 19, when positioned adjacent the respective conveyors of conveyors 5 and 7 are moved to the open position. This allows the discharge and feeding of containers 6 from and into the respective notches 18. The cams 32 and 33 are contoured such that, upon rotation of the turret 8, the followers 26 will move into engagement with the central disc 31 whereby the gripping means 19 moves to a gripping position wherein the gripper 21 will engage a portion of the sidewall of a container 6 when moving from the conveyor 7. When the turret 8 moves to the conveyor 5, the cams 32 and 33 effect pivoting of the cams 23 moving to the conveyor to move the gripping means 19 when adjacent the conveyor 5 to an open position. By virtue of the gears 24 and 25 being meshed together, simultaneous actuation of the gripper 20 with the respective gripper 21 is effected.

In the illustrated structure, the apparatus 1 includes four stations, including a feed station located adjacent the conveyor 7, the orienting station 3, a sealant dispensing station adjacent the means 4 and an outlet station adjacent the conveyor 5. The central disc is contoured such that the jaws would normally remain in a gripping position at both the orienting station 3 and at the sealant dispensing station adjacent the dispensing means 4.

In a preferred embodiment of the present invention, the containers 6 are rotated at the orienting station 3 thereby necessitating that the containers be free to rotate. One advantageous way of accomplishing this would be to move the grippers 20 and 21 to a non-gripping position when at the orienting station 3. In the illustrated structure, means is provided to effect selective pivoting movement of the arms 23 at the orienting station and thereby the respective arms 22 such that the grippers 20 and 21 move to a position out of engagement with a respective container 6. The means in the illustrated structure includes a selectively extendable and rotatable pneumatic ram 36 mounted on the disc 31 by a mounting block 37 which is secured to the disc 31. A pair of eccentric or cam members 38 are mounted on respective shafts 39 which are pivotally mounted in the block 37. The eccentric members 38 are positioned for selective engagement with a respective follower 26 to effect pivoting movement of the respective arm 23. An arm 35 is connected to each of the shafts 39. One arm 35 is pivotally connected to the ram 36 at a clevis 41 secured to the movable rod portion of the ram 36. A link 42 is pivotally connected to each of the arms 35 whereby pivoting movement of the arm 35 connected to the ram 36 will effect simultaneous pivoting movement of the other arm 35. By virture of the members 38 being eccentric and engageable with a respective follower 26, pivoting of the eccentric members 38 will effect pivoting movement of the respective arm 23 and the respective arm 22, to override operation of the disc 31 to move the grippers 20 and 21 to a non-gripping position. Timing of the extension of the ram 36 to effect the movement of the grippers 20 and 21 to their non-gripping position is controlled by the control means described hereinbelow. Upon retraction of the ram 36, the followers 26 under the bias of the resilient members 27 move back into engagement with the peripheral edge of the disc 31 and are once again in a container gripping position.

Figure 2:
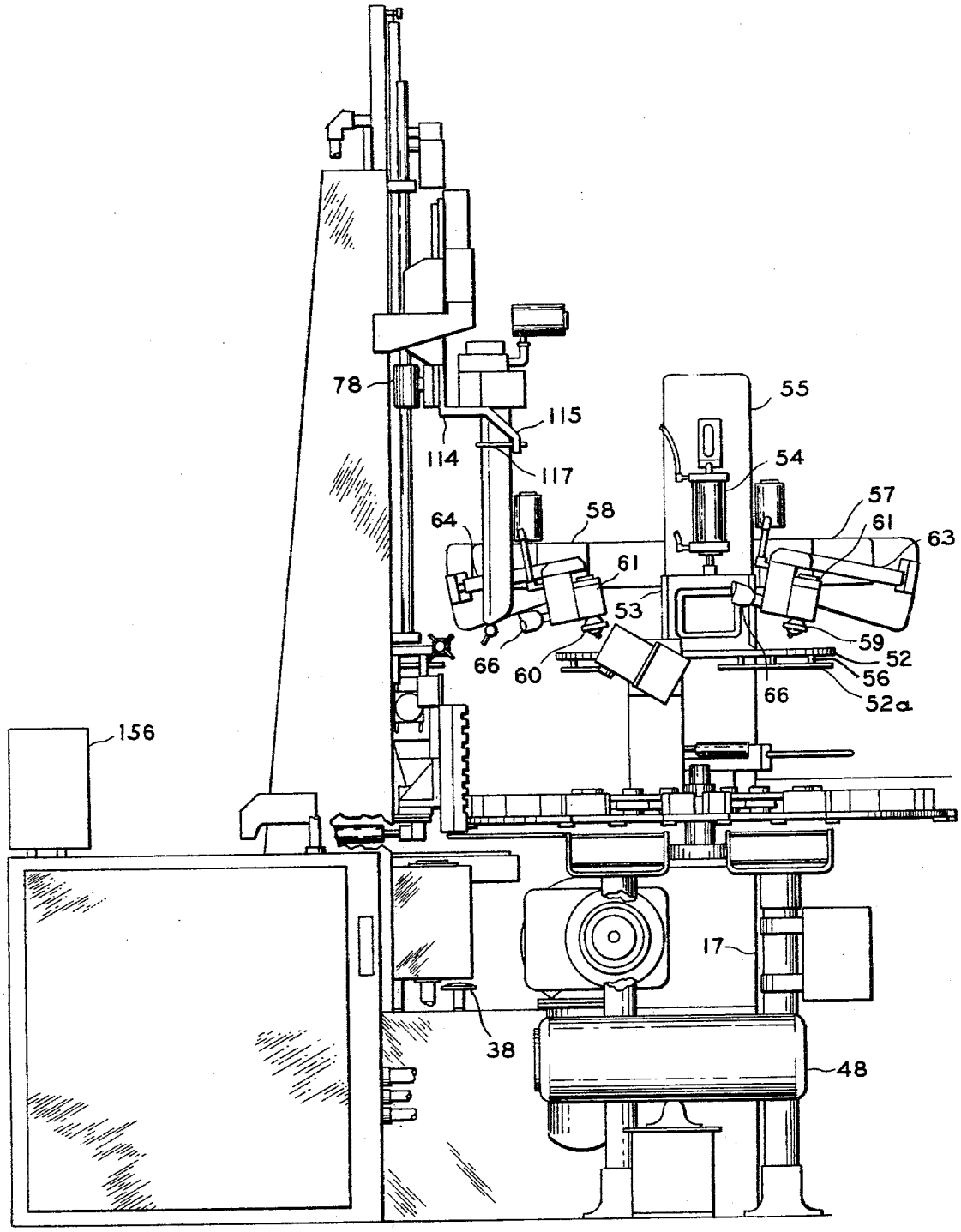
FIG. 2 is a side elevational view of the apparatus illustrated in FIG. 1.
Figure 3:
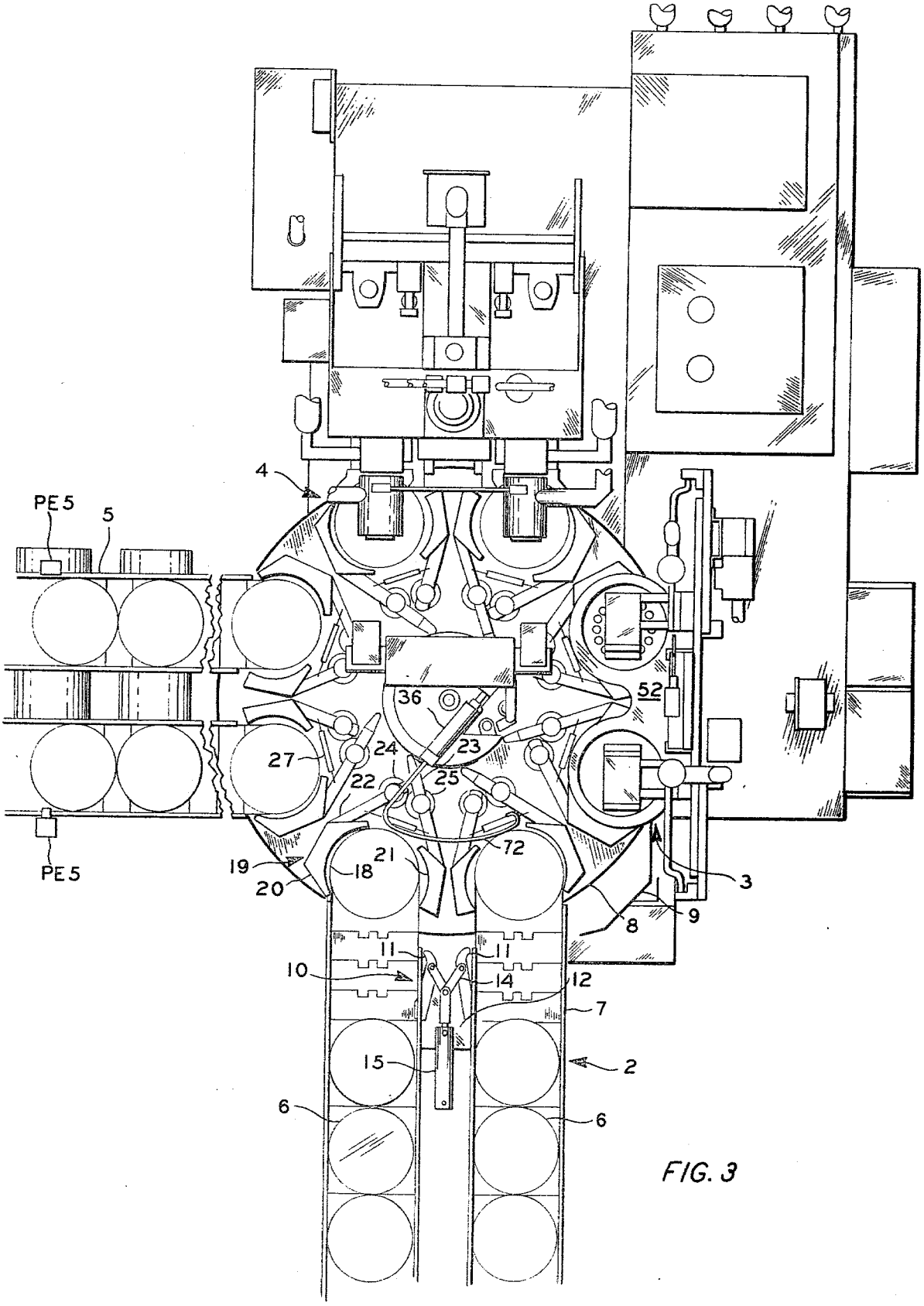
FIG. 3 is a plan view of the apparatus of FIG. 1.
Figure 5:
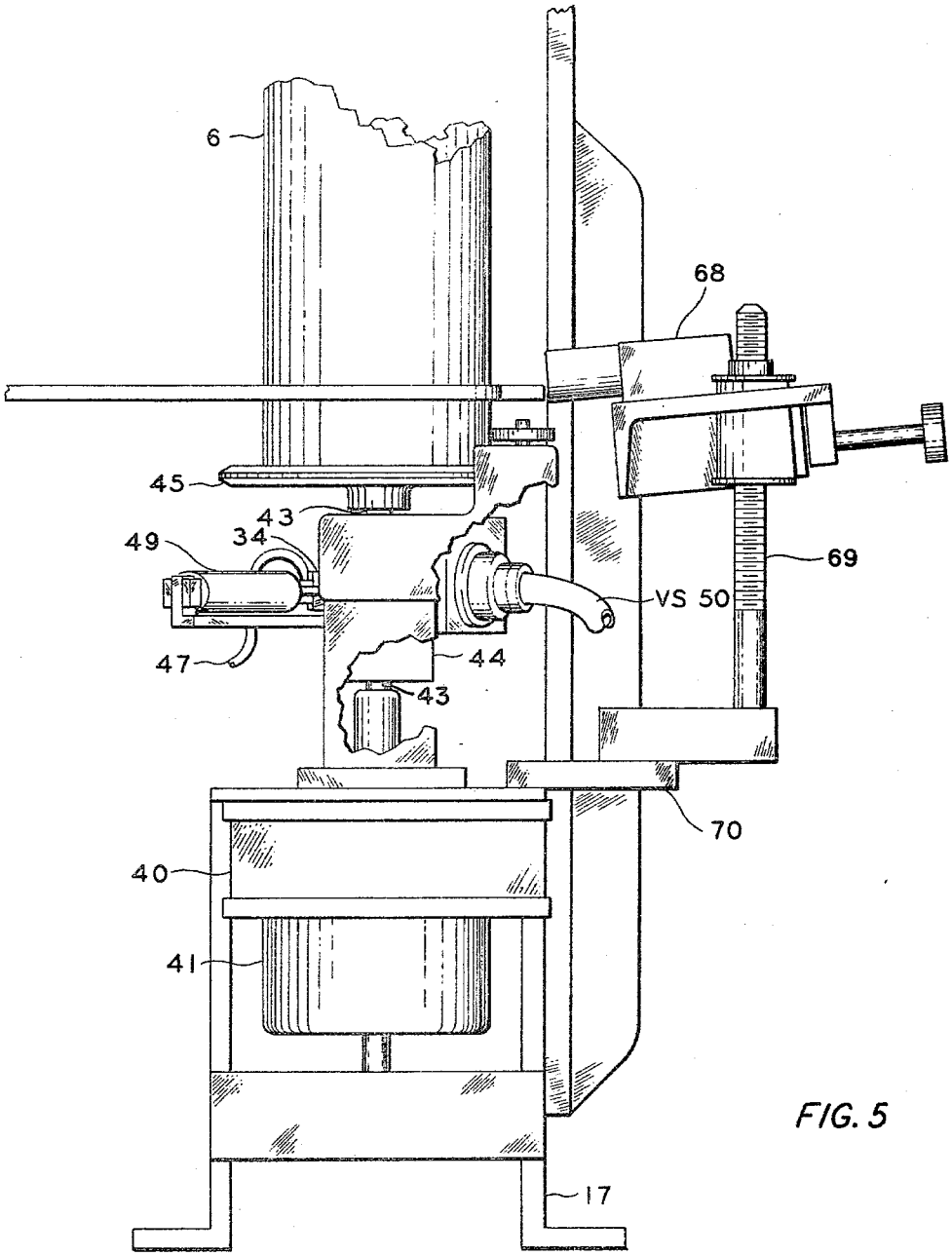
FIG. 5 is an enlarged fragmentary elevational view of a sealant dispensing and container orienting station.

Preferably, the apparatus 1 includes means at the orienting station 3 for applying sealant to the bottom seam, i.e., the seam between the bottom member and the sidewall of the container 6. The means are best seen in FIGS. 2 and 5. Because the apparatus 1 will handle a pair of containers simultaneously at each of the four stations, the orienting station 3 will simultaneously accommodate two containers. The illustrated means for applying sealant to each of the container bottom seams are substantially the same, therefore the description of one side of the station applies also to the other side of the station.

A motor 40 is mounted on the frame 17 with the motor preferably being of a type which has substantially no inertia such as a PMI Pancake Motor #U12M4T with a connector encoder 41 such as a #PU856-360 tachometer encoder, manufactured by a division of Koll Morgan Corp., Syosett, N.Y. The encoder 41 is operably connected to one end of the shaft of the motor 40 and is used as part of the control system which is described hereinbelow. The output shaft of the motor 40 is connected to a shaft 43 which is rotatably mounted in a bearing block 44. Mounted on top of the shaft 43 there is a platform 45 which is rotatable when driven by the motor 40. The platform 45 and shaft 43 are aligned relative to the grippers 20 and 21 at the respective station such that the grippers 20 and 21 will align a container 6 generally coaxial with the axis of rotation of the platform 45. The platform 45 is positioned below the turret 8 and has a plurality of passages 46 opening onto the upper disposed surface thereof. The passages 46 communicate with another passage (not shown) which extends through the shaft 43 and is in flow communication with a conduit 47 which is connected to a vacuum source such as a vacuum pump 48 shown in FIG. 2. The application of vacuum will releasably retain a container on the platform 45 during rotation of the container 6. A resilient annular pad 51 is recessed in the surface of the upper platform 45 and serves to provide a sealing surface with the bottom of container 6 during application of the vacuum. A means is provided for selectively releasing the vacuum applied for retaining the container 6. In the structure shown, the means includes a pneumatic ram 49 mounted on the block 44 and actuates a slide valve 34 connected in the conduit 47 preferably at the block 44. The valve 34 vents the passage 46 to atmosphere to release the vacuum at a predetermined time. The operation of the ram 49 and, hence, operation of the valve 34, is controlled by the control circuit as described below. A switch VS 50 is also mounted on the block 44 and has a pressure-sensing element cooperating with the vacuum passage (not shown) in the block 44 with the switch VS 50 being actuated at a predetermined level of vacuum pressure. Actuation of the switch VS 50, which is operably connected to the motor 40, allows the motor 40 to rotate only after a predetermined level of vacuum is attained. Thus, the platform 45 will not rotate unless a container 6 is securely retained thereon by vacuum.

Positioned above the platforms 45 is a tamper device 52 having rings **52*a* resiliently movably mounted thereon preferably springs 56 as is best seen in FIG. 2. The tamper is movably mounted on a guide 53 for generally vertical reciprocal movement. A pneumatic ram 54 or the like is mounted on a support 55 which in turn is secured to the frame 17. The movable rod of the ram 54 is connected to the tamper 52 to effect the reciprocal movement thereof at a predetermined time as controlled by the control system described below. The tamper 52 when engaging the containers 6 insures contact between the containers 6 and platforms 45 for application of vacuum and with the rings 52*a*** being resiliently mounted the containers will be less liekly to be deformed.

Arms 57 and 58 are secured to the support 55 and extend generally outwardly therefrom, each having mounted thereon a respective sealant dispensing nozzle 59 or 60. The nozzles are each operably connected for flow communication with to a solenoid valve means 61 which is selectively actuatable for permitting dispensing of a viscous liquid sealant through the respective nozzle 59 or 60. The nozzles 59 and 60 and their respective valve 61 are mounted on a bracket 63 and 64, respectively, with the brackets 63 and 64 being pivotally mounted on the respective arm 57 and 58. By being pivotally mounted on the arms 57 and 58, the angular position of the nozzles 59 and 60 can be adjusted, when desired, to change the trajectory of the stream of sealant being dispensed to accommodate different size containers. A conduit 66 is connected to each of the valves 61 for supplying sealant thereto.

Referring again to FIG. 5, mounted adjacent each of the platforms 45 is a photoelectric transducer means, such as a photoelectric eye 68, which is operable for sensing a mark on the container so that the container can be oriented to a preselected rotational position as described hereinbelow in the description of the control system. The eyes 68 are each mounted on a threaded rod 69 such that both the height and rotational position of the eyes 68 can be readily and simply adjusted. The rods 69 are each mounted on a respective support 70 which in turn is mounted on the frame 17.

The valves 61 and nozzle assemblies 59 and 60 can be of any suitable type and, preferably, they are of a heated type such as a Nordson, Model H-20A. Further, the conduits 66 are also preferably heated and can be of a type such as those available from the Nordson Corp. of Amherst, Ohio. By heating the valves 61 and the conduits 66, the sealant is maintained in a heated condition since it is preferred to use a hot melt sealant.

After the containers have had sealant applied to the bottom seam at the station 3, the ram 36 is moved to its retracted position allowing the grippers 20 and 21 to once again grip the containers 6 after orientation. The turret 8 is then indexed to the next station. At the next station, the means 4 is operable for applying sealant or the like to the interior side seam of the container. Preferably, the side seam extends generally longitudinally along the length of the container 6 from the top of the container to the bottom member of the container 6. Applying sealant to the container can be readily accomplished because the containers 6 have been oriented at the orienting station 3 to precisely locate the rotational position of the containers 6. The containers 6 move from the station 3 to the dispensing means 4 by the indexing rotation of the turret 8 with the containers sliding along the plate 9 below the turret 8.

Referring to FIGS. 1, 2, 6, 7, and 8, a carriage 75 is movably mounted on a support 76 which is secured to the frame 17. The carriage 75 is movably mounted on the support 76 for movement generally parallel to the side wall of the container 6 which movement is generally vertical reciprocal movement. As illustrated, the carriage 75 is slidably mounted on a pair of guide rods 77 secured to frame 17. The carriage 75 is slidable in bearing blocks 78 which are mounted on the back of carriage 75 as best seen in FIG. 2. A pneumatic ram 79 or the like is mounted on the support 76 and has the movable rod portion thereof connected to the carriage 75. As illustrated, extension of the ram 79 effects downward movement of the carriage 75 and retraction of the ram effects upward movement of the carriage 75.

As shown, a pair of sealant dispensing nozzles 81 are carried by the carriage 75 for movement therewith. The nozzles 81 are operable for dispensing viscous liquid sealant onto the side seam of the container. In the illustrated structure, the nozzles 81 are mounted on an elongate wand 82 which in turn is secured to the carriage 75. Selective dispensing of sealant from each of the nozzles 81 is effected by use of a respective solenoid controlled valve means 84 connected in flow communication with the respective nozzle 81. As viewed in FIG. 1, the right hand wand 82 has the valve means 84 controlled by a solenoid SOL 7 while the left hand wand 82 has its valve 84 controlled by solenoid SOL 8. Preferably, the wands 82 are of a construction which permits the heating of the wand so as to prevent the sealant from becoming too viscous for proper dispensing. The wands 82 preferably have one or more cartridge heaters (not shown) mounted therein which are connected to a suitable temperture controller VC1 described below. Conduits 85 are in flow communication with the respective valve 84 and are operable for supplying heated sealant to the respective valve. Preferably, the conduits 85 are of a heated type such as sold by Nordson Corp. of Amherst, Ohio.

Movement of the carriage 75 is effected by the ram 79 as discussed above. When the carriage 75 reaches its down position, the ram 79 upon retraction will move the slide 75 upwardly. In the event sufficient air pressure is not present to effect retraction of the ram 79 under the load of the carriage 75, one or more springs 86 are connected to the carriage 75, which upon downward movement of the carriage 75, were placed in a tensioned condition, the force applied by the springs 86 is available for inducing upward movement of the carriage 75. Preferably, the end of the movement of the carriage 75 downwardly and upwardly is cushioned to prevent unnecessary vibration or shock in the apparatus 1. The rams 79 can be of a cushion type to provide shock absorbency on both the up and down stroke. Further, on the up stroke of the carriage 75, due to the added force of the springs 86, a supplementary shock absorber 88 can be provided. The shock absorber 88 is mounted on a bracket 89 which is secured to the support 76. The shock absorber 88 can be of any suitable type, such as a hydraulic type which is connected to a source of hydraulic fluid such as a reservoir 90. A rod portion **88*a* of the shock absorber 88 is engageable with a bracket 90' secured to the carriage 75. Upon contact of the bracket 90' with the rod 88*a*** shock absorbency is provided.

Figure 9:
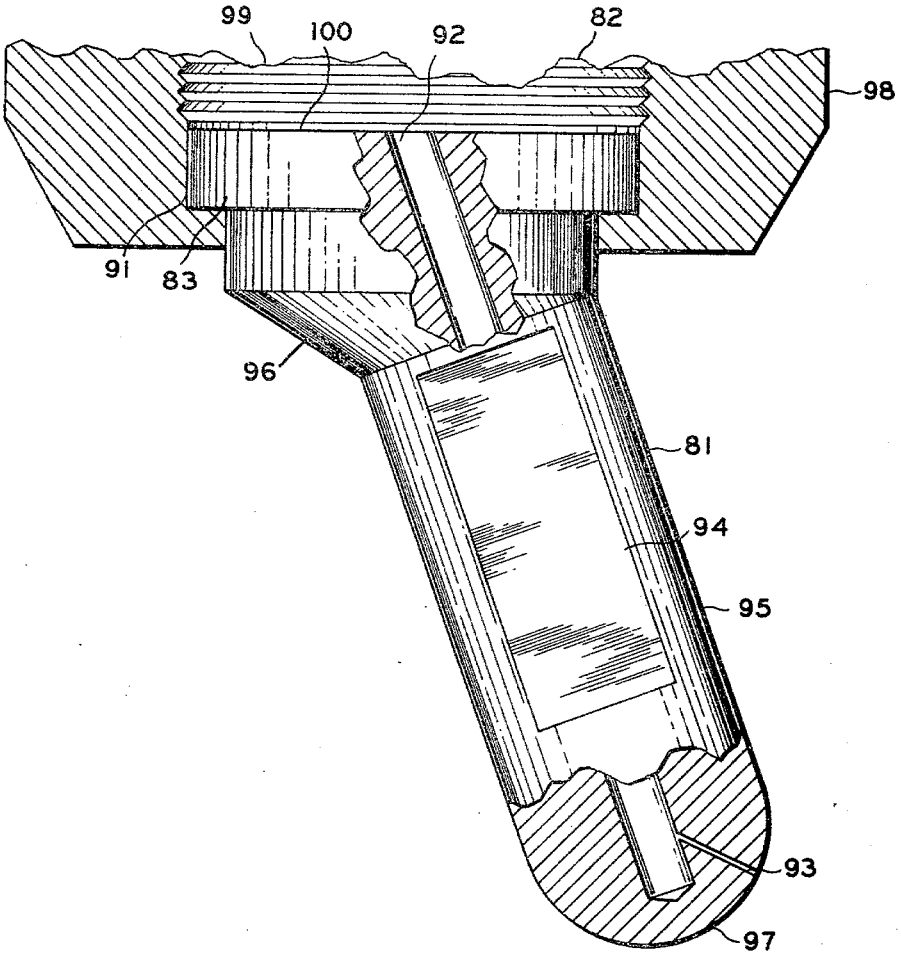
FIG. 9 is an enlarged fragmentary view of a nozzle used for dispensing sealant.
Figure 10:
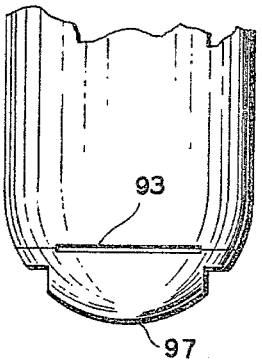
FIG. 10 is an enlarged fragmentary view of a portion of the nozzle illustrated in FIG. 9.
Figure 11:
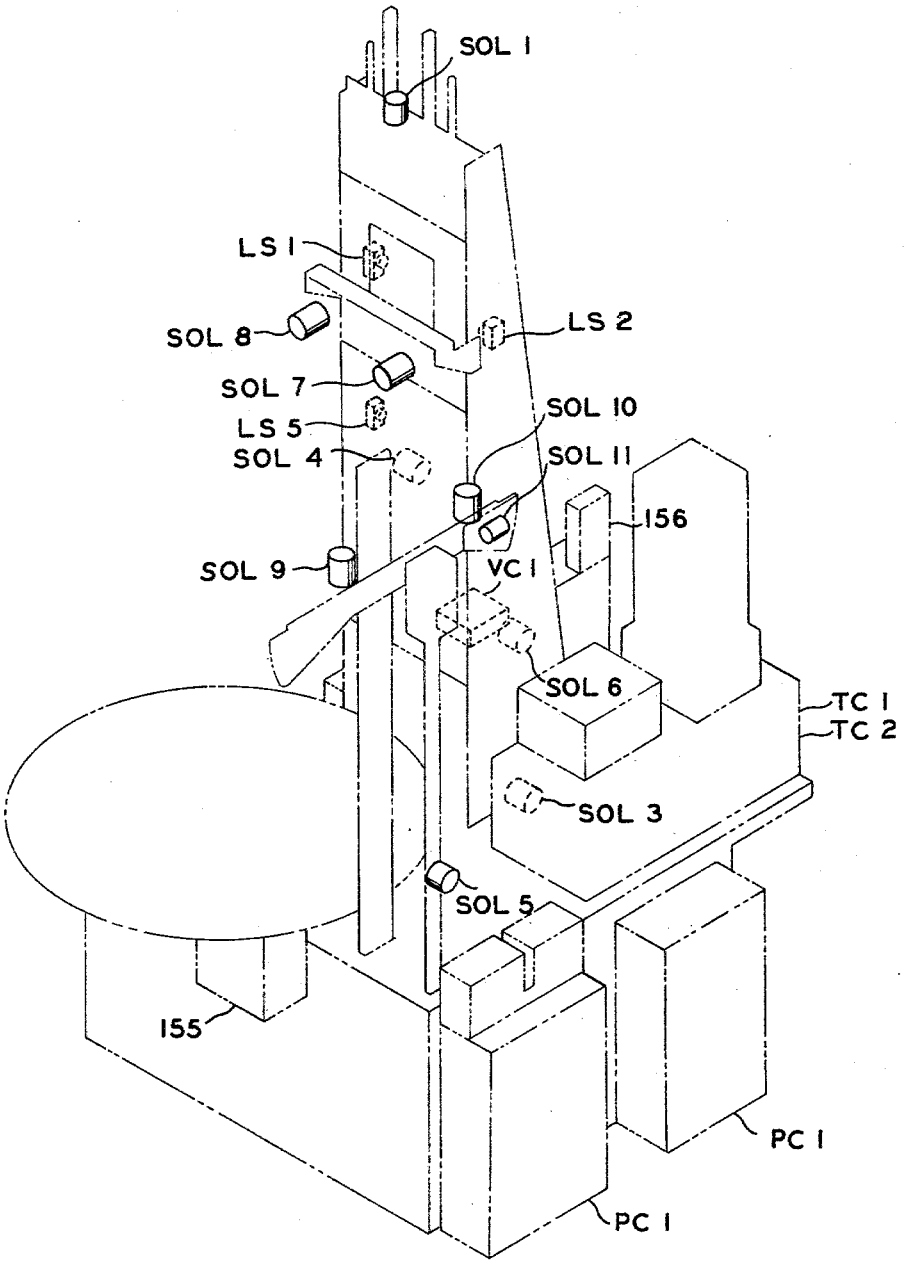
FIG. 11 is a perspective illustration of the apparatus illustrated in FIG. 1 illustrating the location of various control mechanisms.

Details of the nozzles 81 are best seen in FIGS. 9 and 10. The nozzle 81 is adapted for dispensing a relatively viscous fluid such as hot melt sealant in a thin ribbon. As illustrated, the nozzle 81 has a body with a first portion 83 adapted for mounting on the threaded ends of wand 82. The nozzle has a leg portion 95 integral with the first portion 83. A cylindrical flow passage 92 is provided inside the nozzle 81 and extends from the upper end 100 through the portion 83 for flow communication with the flow path in the wand 82 and extends partially through the portion 91 terminating adjacent the lower end 97 of the nozzle 81. A second flow passage 93 opens onto the exterior surface of the nozzle 81 adjacent the end 97 and is generally rectangularly shaped in transverse cross section as best seen in FIG. 10. The passage 93 has a width in the range of about 5 to 100 times the height of the passage 93. The use of the nozzle as described above is highly advantageous in that it has been found that such a nozzle will not leak or drip sealant and thereby form a a bad coating on the seam. Satisfactory operation has been obtained from a nozzle wherein passageway 92 is 0.0625" in diameter and passageway 93 is 0.006"×0.1875". A preferred hot melt adhesive is Swift SK8.12.8750H sold by Swift & Co. and is a product of United Chemical Co. of Chicago, Ill. A suitable temperture for dispensing the adhesive is 375° F. (190° C.). Another suitable hot melt adhesive is Finley #3355-885PB sold by Finley Adhesives, Inc. of Milwaukee, Wis.

As seen in FIG. 9, the nozzle 81 has a pair of flat surfaces 94 on opposite sides with the surfaces 94 permitting the use of a wrench for installing or removing the nozzle 81 from the threaded end of wand 82. The portion 83 has a generally annular collar 91 projecing therefrom. As illustrated, a nut 98 or the like receives the portion 83 therein and is in threaded engagement with a lower portion 99 of the wand 82. A shoulder in the nut 98 engages the collar 91 thereby securing the nozzle 81 on the wand 82.

The leg portion 95 is preferably integral with the portion 96 wherein the longitudinal axis of the portion 83 and the leg portion are disposed at an angle relative to one another in a preferred embodiment. Preferably, the angular disposition should be in a range between about 18° and about 22°. The angular relationship allows the end 97 to project outwardly a distance sufficient to permit the end of the passage 93 to be located at a desired location relative to a container 6 for sealant dispensing without having the wand 82 contact a container 6. An angle of about 20° has been found to be satisfactory. Also, the passage 93 is disposed at an angle relative to the longitudinal axis of the passage 92 and, preferably, this angle is in a range between about 40° and about 50°. An angle of about 45° has been found to be satisfactory. By disposing the passage 93 at an acute angle relative to vertical, sealant can be discharged onto the container sidewall at a position adjacent the bottom seam without having the end of the nozzle 81 contact the bottom member of the container.

The nozzle as above described is manufactured by first forming the exterior of the body of the nozzle 81 in any suitable manner such as on a lathe, die casting or the like. Preferably, the nozzle is formed from a relatively soft metal such as brass. After or during formation of the body, the surfaces 94 are formed in any suitable manner. The passage 92 is drilled or otherwise formed in the nozzle 81, preferably terminating just short of the free end 97. After the formation of the passage 92, a slot is milled or otherwise formed across the leg 95 from one side of the leg 95 to the other side of the leg 95. After forming this slot, an anvil member such as a hardened shim having a shape and size which is substantially the same as the desired shape of the passage 93 is inserted into the slot. After insertion of the member, the nozzle 81 is placed in a press or other suitable forming equipment and the end 97 of the leg 95 has force applied for closing the slot on opposite sides of the inserted member to form the passage 93. After the formation operation has been completed, the member is removed leaving the passage 93 of the desired size and shape. Preferably, the passage is generally rectangularly shaped in transverse cross section with two pairs of generally parallel surfaces. The passage 93 is sized such that the capillary forces of the sealant will prevent dripping.

Figure 6:
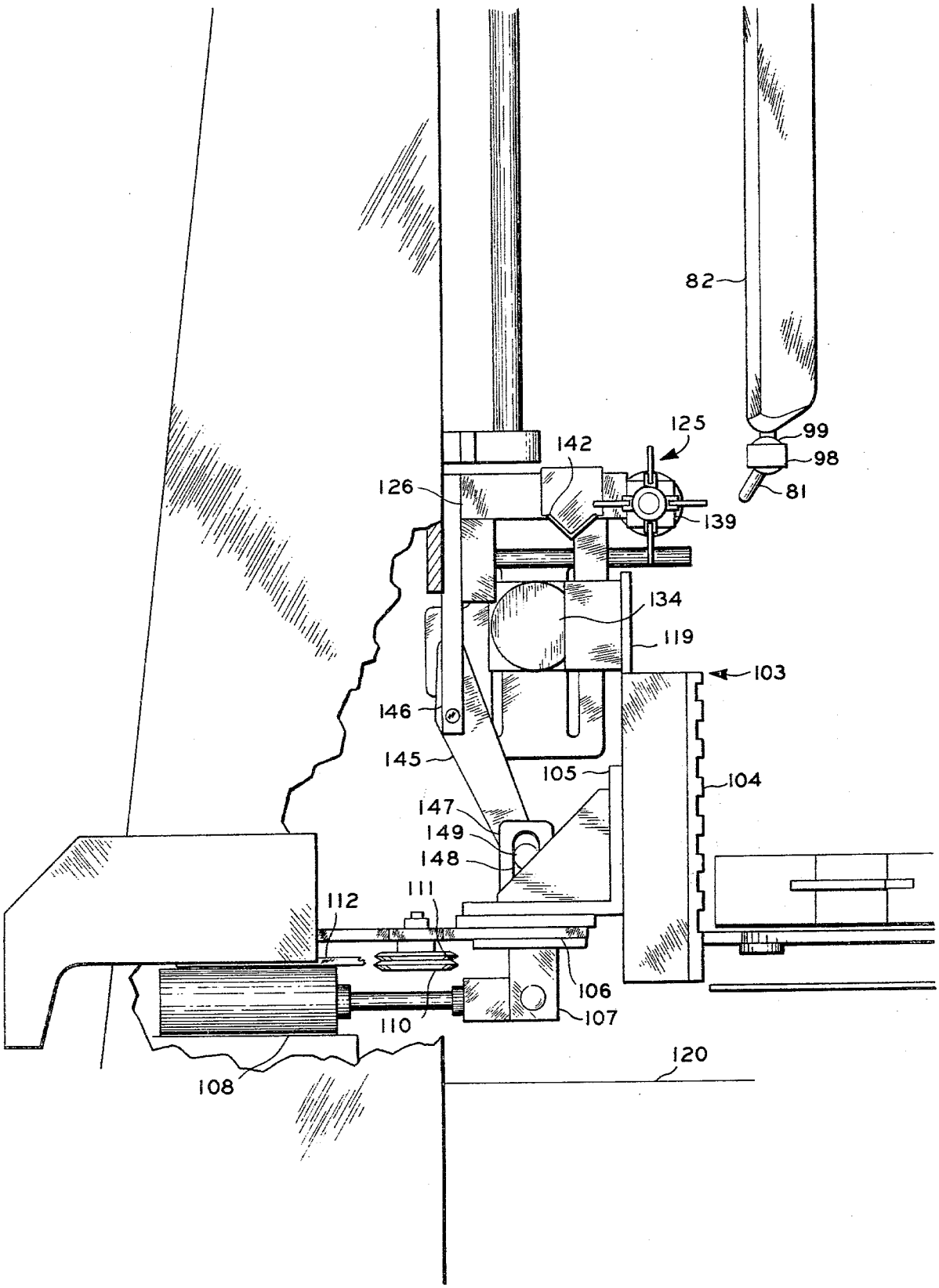
FIG. 6 is a enlarged fragmentary side elevational view of a second sealant dispensing station.

In operation of the apparatus 1, it is preferred to stabilize the containers when applying sealant to the side seam to improve the quality of the seal at the side seam. As best seen in FIG. 6, stabilizing means 103 is provided for selectively stabilizing a container 6 at each of the sealant applying locations adjacent the sealant dispensing means 4. It has been found desirable to stabilize the container 6 during application of the sealant to prevent movement of the container when the sealant is being applied. This is particularly true with tall containers in that they have a tendency to tip and move away from the nozzle because of the force applied to the container 6 by the sealant stream being applied to the side seam. This is particularly important because the spacing of the side wall of the container from the nozzle 81 has been found to be a relatively critical parameter which should be controlled closely to achieve high quality sealed seams.

In the illustrated structure, the stabilizer means 103 includes a container engaging member 104 which is adapted for engaging a container 6 in selected areas substantially along the entire height of the container, preferably in a selected area around about one-fourth of the periphery of the container. The member 104 is constructed to avoid contact with the grippers 20 and 21. The member 104 is positioned relative to the side seam so that the side seam is located about centrally between side edges of the member 104. The member 104 is suitably secured to a bracket 105 which in turn is suitably secured to a plate 106. A bracket 107 is suitably secured to and depends from the plate 106 and has suitably connected thereto a free end of a movable rod portion of a pneumatic ram 108 or the like which is mounted on the frame 17 of the apparatus 1. Selective extension and retraction of the ram 108 effects forward and retracting movement of the member 104, bracket 105, plate 106 and bracket 107. The plate 106 has suitably secured thereto a plurality of rotatably mounted rollers 110. The periphery of each of the rollers 110 has a groove 111 therein and is adapted for engaging a guide member 112 for movably supporting the member 104, bracket 105, plate 106 and bracket 107 for generally linear recriprocal movement. In operation, the member 104 is moved toward a respective notch 18 for engaging a container 6 when sealant is dispensed. After application of sealant, the member 104 is retracted by retraction of the ram 108 to move the member 104 out of engagement with a container 6 and out of the notch 18 to permit selected indexing of the turret 8. Operation of the ram 108 in timed sequence to operation of the other components of the apparatus 1 is controlled by a control circuit described hereinbelow.

Figure 1:
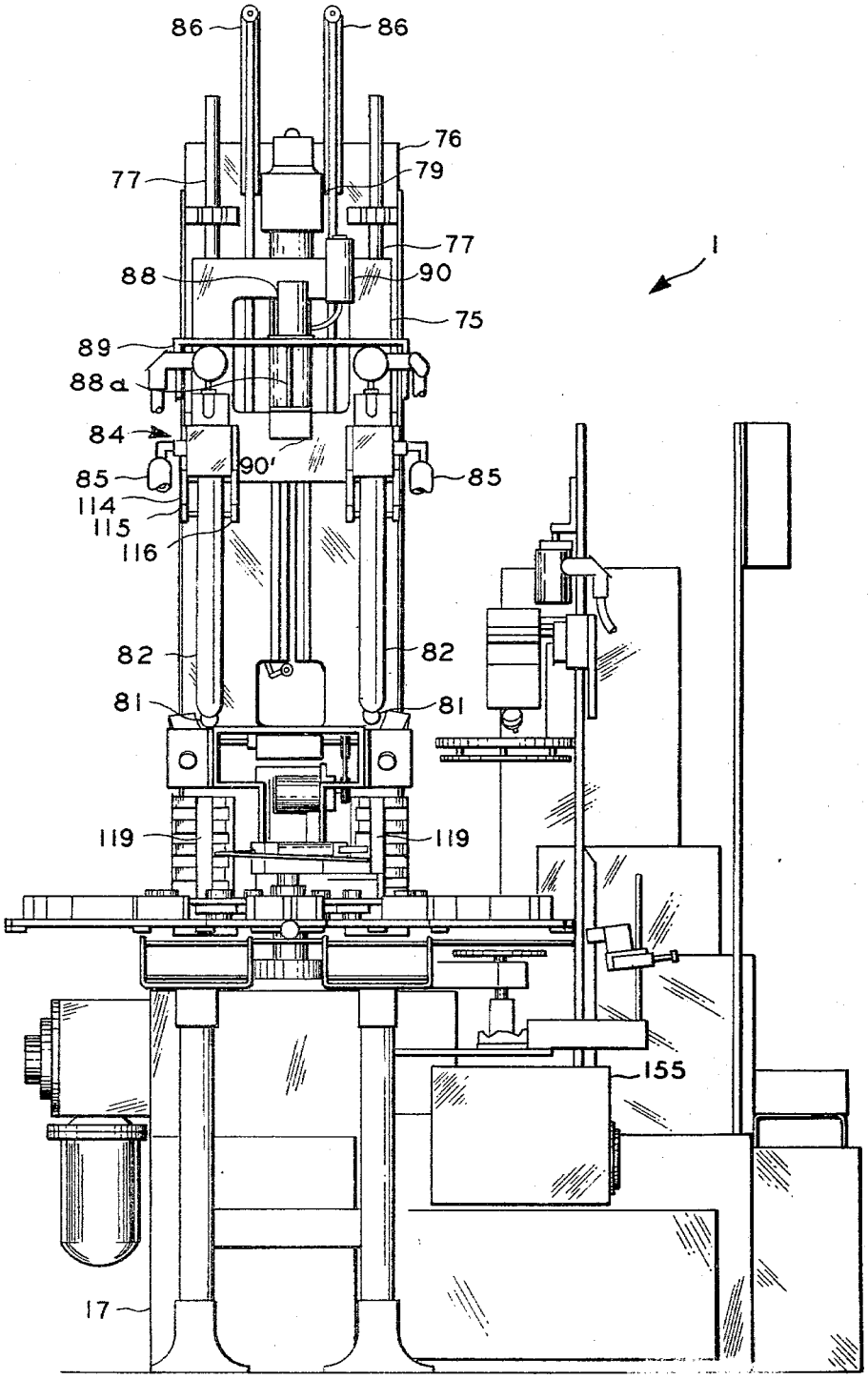
FIG. 1 is a front elevational view of a container processing apparatus.

Because of the importance of positioning the nozzle 81 relative to the side seam of the container 6 so as to maintain a predetermined spacing therebetween, adjusting means is provided. In the illustrated structure, the adjusting means includes a bracket 114 secured to the carriage 75 with the bracket having a pair of spaced apart arms 115 and 116 positioned on opposite sides of the wand 82 as best seen in FIG. 1. In the illustrated form of the adjusting means, a U-bolt extends partially around the wand 82 with each end of the U-bolt 117 extending through an opening in the respective arm 115 or 116. Nuts are in threaded engagement with the U-bolt and by tightening or loosening of the nuts, the wand 82 can be resiliently biased to a preselected position such that the nozzle 81 is at the proper spacing from the interior surface of the container 81.

Means is provided for facilitating removal of or preventing buildup of sealant on the apparatus 1 in the event overspray, i.e., spraying of sealant other than on the container, occurs. In a preferred embodiment of the present invention, each of the members 104 has mounted thereon, at a position at which the nozzles 81 are directed, an elongate heater 119, as best seen in FIGS. 1 and 6. Preferably, the heater 119 is an electrical resistance type heater and is in the form of an elongate strip which extends generally from the lowermost disposed portion of the member 104 and up beyond the upper end of the member 104. By being heated, when overspray occurs, the sealant will remain fluid and flow down the heater strip 119 and fall on a plate 120 mounted on the frame 17 from which the sealant can be easily removed.

Figure 7:
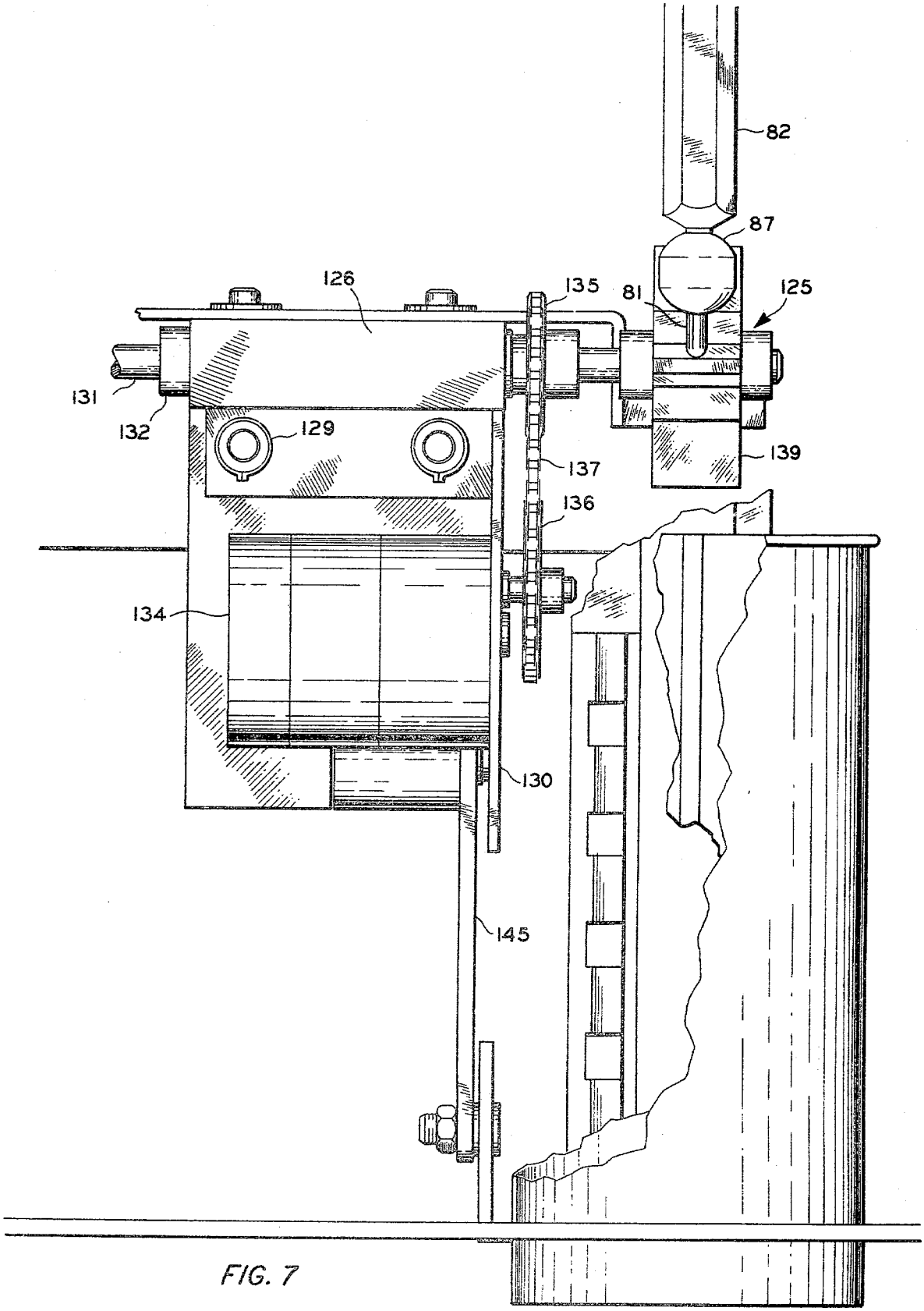
FIG. 7 is an enlarged fragmentary view of the sealant dispensing station illustrated in FIG. 6.
Figure 8:
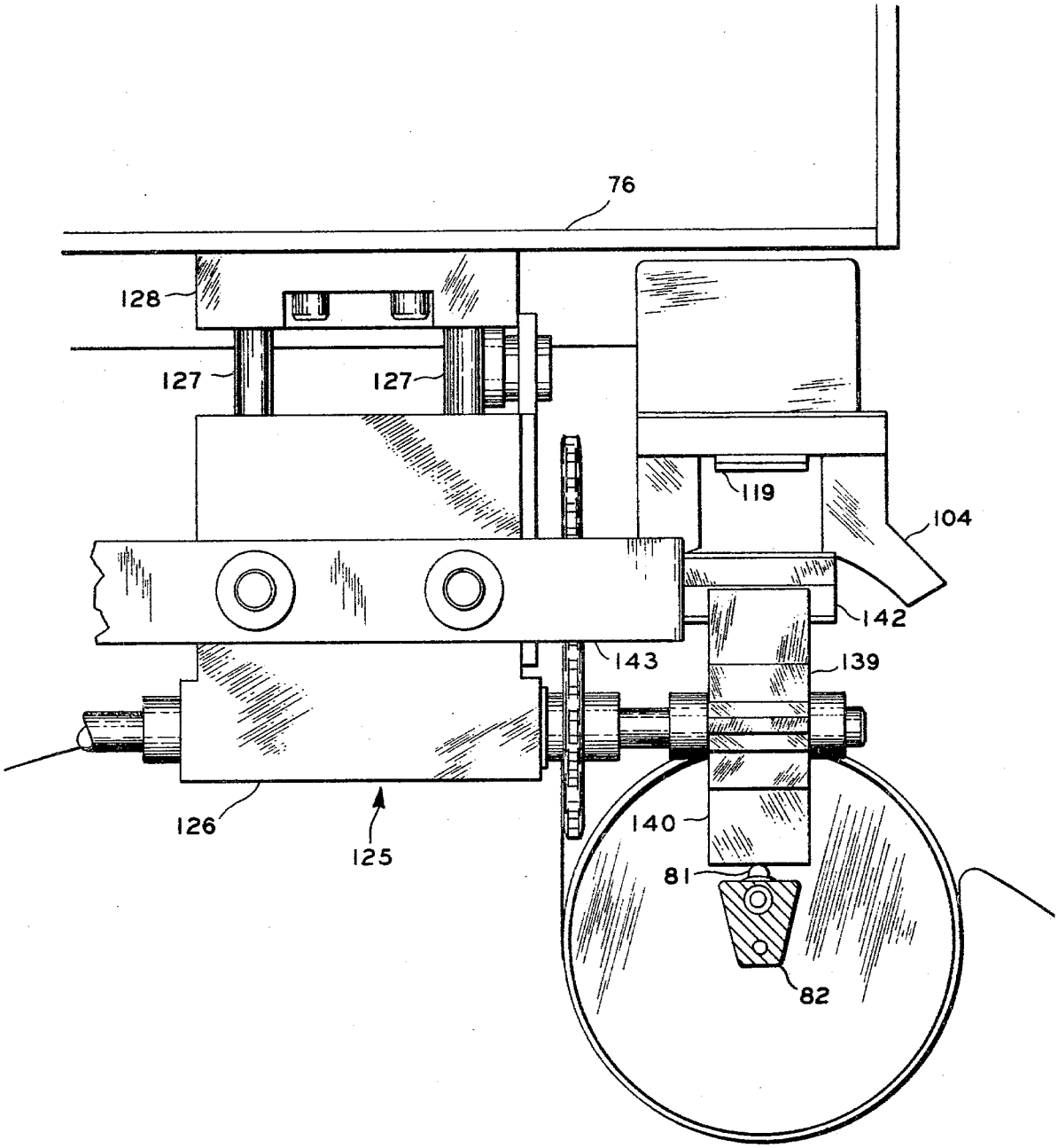
FIG. 8 is an enlarged fragmentary plan view of the sealant dispensing station illustrated in FIGS. 6 and 7.

The apparatus 1, in the illustrated form, includes means 125 for removing any excess sealant from the nozzle 81 in the event sealant is discharged from the nozzle 81 after the control valve is shut off. Such means may or may not be necessary, depending upon the type of nozzle used. However, as an added feature for the apparatus 1, wiping means 125 is provided and can be utilized to assure that no sealant is left on the end of the nozzle 81 after termination of sealant dispensing. The wiping means is best seen in FIGS. 6, 7, and 8. As shown, a carriage 126 is recriprocably movably mounted on the support 76 for generally linear movement. As shown, a pair of guide rods 127 are secured to a bracket 128 which in turn is suitably secured to the support 76. The carriage 126 has a pair of through bores which have mounted therein respective bearings 129 for slidably receiving the respective rod 127 therethrough. A bracket 130 is secured to the carriage 126 and is secured in such a manner as to depend from the carriage 126 and is movable with the carriage 126. A shaft 131 is rotatably mounted in bearings 132, which are in turn mounted in the carriage 126, to allow rotation of the shaft 131. Drive means is provided for rotating the shaft 131 and, as illustrated, the drive means includes a motor 134 mounted on the bracket 130. A sprocket 135 is secured to the shaft 131 and a sprocket 136 is secured to the drive shaft of the motor 134. A chain 137 operably connects the pulleys 135 and 136 together whereby rotation of the motor 134 effects rotation of the shaft 131. Mounted on each end of the shaft 131 is a hub 139. The hub 139 has a plurality of generally radially projecting wiper blades 140 which are preferably of a resilient material such as rubber. As viewed in FIG. 6, it is preferred that the hub 139 have counterclockwise rotation so that the wipers 140 when adjacent the nozzle 81 will move upwardly relative to the nozzle 81 having a surface 141 which will engage the nozzle 81. This rotation is desirable since any sealant on the nozzle 81 will tend to flow downwardly whereby upward movement of the wiper 140 will pick up substantially the entirety of any excess sealant. If any sealant is removed from the nozzle 81, further rotation of the hub 139 will move the wiper to a receptacle such as an upwardly opening V-shaped trough with a collecting chamber for engagement with an edge of the trough 142. When the surface 141 engages an edge of the V-shaped trough 142, the sealant will be wiped off into the trough. The trough 142 is carried by the support 76, preferably by having the troughs 142 secured to a bracket 143 which in turn is secured to the carriage 126 for movement therewith. The troughs 142 can be heated or unheated and when sufficient sealant is built up, it can either be manully removed in the event of an unheated trough or in the event of a heated trough the sealant can drain out of an open end of the trough onto the plate 120 from which it can be easily removed.

Means is provided for effecting reciprocal movement in the wiping means 125 in timed relationship to the operation of the remainder of the apparatus 1. Preferably, the wiping means 125 will move outwardly such that the wipers 140 will engage a respective nozzle 81 when the nozzle 81 is in its up position as illustrated in FIG. 6. One advantageous means of effecting the recriprocal movement toward and away from the nozzle 81 is by having the wiping means 125 operably connected to the stabilizing means 103 whose operation is effected in timed relationship to the various operations of the apparatus 1. As illustrated, an arm 145 is pivotally mounted on a bracket 146 which is secured to the support 76 and is immovable relative to the support 76. A guide cam 147 is secured to the bracket 105 and is movable therewith. The guide cam 147 has an elongate slot 148 therein and receives therein a roller 149. The roller 149 is rotatably mounted on the arm 145 adjacent the lower end of the arm 145. An upper end of the arm 145 is on the other side of the pivotal mount from the lower end of the arm 145 and has a roller (not shown) similar to the roller 149, mounted thereon. A portion of the bracket 130 has an elongate slot (not shown) therein similar to the slot 148. During extension of the ram 108 and forward movement of the bracket 105 the arm 145, seen in FIG. 6, moves in a generally counterclockwise direction pulling the wiping means 125 to a retracted position and away from the nozzle 81. After the nozzle 81 has dispensed sealant, it moves to its uppermost position. At this time, the ram 108 retracts moving the stabilizer 104 to its retracted position. This effects clockwise movement of the arm 145 thereby effecting forward movement of the wiping means 125 to an extended position wherein the wipers 140 will engage the nozzle 81 and wipe off any sealant on the end of the nozzle 81 and will continue to wipe sealant until the wipers 140 are moved out of a wiping position by extension of the ram 108.

After the sealant has been applied and the members 104 moved to a retracted position, the turret 8 will again sequentially move whereby the containers 6 with both the bottom seams and side seams coated will move to a position for discharge onto the discharge conveyor 5. As described above, when the turret moves grippers 20 and 21 to the discharge conveyor stations, these grippers 20 and 21 are moved to an open position by action of the cams 32 and 33 to permit discharge of the processed containers 6. The conveyor 5 includes a pair of conveyors each located under a respective notch 18 and by virture of the friction between the containers 6 and the conveyors the containers 6 will be removed from the notches 18. The conveyor 5 can be of any suitable type such as an endless belt on chain.

The conveyor 5 will conduct the process containers 6 to a point of use or storage. In the event the containers are conveyed to a point of use, it is desirable to provide means to provide a signal representing that the conveyor 5 is full so that processing of containers on the apparatus 1 can be temporarily terminated. If the conveyor 5 is full, then processed containers 6 cannot be discharged onto the conveyor 5 thereby causing malfunctioning of the apparatus 1 because the notches 18 moving to the feed conveyor 7 would already contain containers 6.

A control system for the apparatus 1 is described below.

The described parts are electrically connected to one another in the manner illustrated in FIGS. 12*a*, 12*b* and 12*c*. For simplicity, terminology directed to "electrically connected to" has not been provided since it is well understood in the art how the parts are connected and the detailed figures show in what manner the various parts are electrically or otherwise operably connected.

Referring to FIGS. 12*a*, 12*b*, 12*c* photoelectric detecting means PE-5 is provided which is operable for providing a signal to the apparatus 1 indicating that the conveyor 5 is filled to a predetermined level. The signal can be utilized to either stop operation of the apparatus 1 or prevent feeding of the containers 6 to the turret 8 whereby containers will no longer be processed until the detecting means PE-5 signals that the conveyor 5 can now accept more processed containers. In the illustrated structure, the detecting means includes a photoelectric transducer means PES such as a photoelectric cell unit model FE-MLS8A with FE-MF3 delay circuit made by Electronic Corp. of America, Cambridge, Mass. illustrated in the schematic in FIG. 12*a*. If the light beam remains broken for a predetermined period of time indicating non-movement of containers 6 along the conveyor 5, i.e., the conveyor 5 is filled to a predetermined level, the ram 15 on the infeed gate will be extended and maintained in the extended position preventing feeding of containers to the turret 8. Feeding is stopped until the light beam makes a circuit in through the cell indicating that the containers are once again moving along the conveyor 5 indicating that the conveyor 5 can accept more processed containers.

A description of the control circuit for the apparatus 1 is provided so as to provide better understanding of the present invention. Power is supplied to the circuit through a transformer T1 with the circuit being fused by fuse F5. A cam switch unit 155 such as a Gemco #1980 104R SP manufactured by Gemco Electric Co., Clawson, Mich., is operably connected to the main drive of the apparatus 1. Power is supplied to the motor M1 which is the main drive motor for the turret indexer from transformer T3. The main start button PB2 is located in the switch box SB1. The switch PB1 resets the overload protector 157. Switch PB2 when actuated provides current to a motor control unit 156 such as a Cycletrol Model 240 sold by Hampton Products Co., Rockford, Ill. and the overload protector 157 such as a Model MOC-1 sold by Hampton Products Co. of Rockford, Ill. The controller 156 is operable for converting 120 VAC to direct current. The overload protector 157 contains relays R9 and R11 (not shown) controlling contacts RC9 in line 5 and RC11 in line 6, respectively. When the relay R11 is actuated by the presence of an overload condition in the turret system, relay contacts RC11 in line 6 move to an open position preventing damage to the turret by preventing relay R10 from being energized since the actuation of contacts RC9 by relay R9 is only momentary. When contacts RC10*a* in line 3 are open, when relay R10 is deenergized, they will prevent the ram 79 from extending. Further, relay R1 has a set of contacts RC1 located in the switch box SB1 and provide a stop circuit to the controller 156 to provide emergency stops to protect the wand 82 or the ram 79 from being damaged due to the turret indexing when the ram 79 is down. Relay R10 is energized during the index or run condition of the turret 8 by closing of the contacts RC9 by actuation of the start button PB2 in switch box SB1. Relay R9 is actuated momentarily only during the very start of the indexer run and since it's closed only momentarily a latching circuit is needed to maintain relay R10 energized during the run phase of the turret cycle. Contacts RC10*b* of relay R10 are located in line 6 and when closed, along with contacts R11, push buttons PB3*b* and PB4*b* are closed, a circuit is provided to relay R10 to maintain same energized. Push button contacts RB3*b* and PB4*b* are secondary sets of contacts for push buttons PB3*a* and PB4*a* which are found in switch box SB1 are for manually stopping the indexer. Relay R11 is energized by the presence of an overload condition in the turret system. If either the push button contacts PB3*b* or PB4*b* or the relay contacts RC11 open the circuit to relay R10, then relay R10 will be deenergized.

The feed conveyor 7 has a gate operated by the pneumatic ram 15 which preferably is a double acting cylinder whereby upon extension of the ram 15 containers are prevented from being fed to the turret 8 and upon retraction of the ram containers 6 can be feed to the turret 8. During operation of the apparatus 1, the solenoid SOL 3, which preferably is part of a 4-way control valve providing air to ram 15, is normally energized by current being supplied through relay contacts R6*b* which are actuated by energizing relay R6 in line 15 by closing of the cam switch CS3 in the cam unit 155. Once each index, the cam switch CS3 is closed allowing the ram 15 to be retracted permitting the feeding of containers to the turret 8. Subsequently, the cam switch CS3 is opened allowing deenergization of the solenoid SOL 3 whereby the ram 15 moves to an extended position preventing containers 6 from being fed to the turret 8 until the next index. As described above, if the conveyor 5 is overly full, it is desirable to prevent feeding of containers to the turret 8. In order to accomplish this relay R12 and the photoelectric transducer means PE5 is provided. PE5 is a photoelectric unit with a set of normally open time closure contacts PECS. When the containers back up on the conveyor 5 until they cover the path of the light beam from PE5, the time delay is energized allowing further backup of containers to a preset position, i.e., a predetermined time period is set in PE5. For the dwell cycle, cam switch CS3 is closed energizing relay R6. When energized during the dwell cycle, contacts RC6*b* are closed while contacts RC12*c* are closed energizing solenoid SOL 3 whereby the cylinder 15 is moved to the retracted position permitting feeding of containers to the turret 8. After the dwell cycle has been completed, cam switch CS3 moves to an opened position deenergizing relay 6 whereby contacts RC6*b* open deenergizing solenoid SOL 3 whereby the cylinder moves to an extended position preventing feeding of containers during the index cycle. In the event an oversupply of containers is present on the conveyor 5 after the predetermined time period, the contacts PEC5 will close. If the apparatus 1 is in the dwell cycle wherein contacts RC6*a* are open and RC6*b* are closed, feeding of the containers will continue for one cycle. At the index portion of the cycle contacts RC6*a* will close and RC6*b* will open whereby relay R12 is energized closing contacts RC12*a* and RC12*b* and will open contacts RC12*c*. With the contacts RC6*b* and RC12*c* open, the solenoid SOL 3 is deenergized whereby the cylinder 15 is in its extended position. During subsequent cycles of the cam switch CS3, the solenoid SOL 3 remains deenergized because the contacts RC12*c* are open. So long as relay R12 is lashed in via current being supplied by contacts RC12*a*, the ram will remain in its extended position preventing feeding. When there is a need for containers contacts PEC5 open. If contacts PEC5 open during the dwell cycle a circuit is provided to the relay R12 through contacts RC6*b* and RC12*b* whereby the ram 15 will remain in its extended position. At the index portion of the cycle contacts RC6*b* will open thereby deenergizing relay R12 with contacts RC12*c* moving to their closed position. At the subsequent dwell cycle then the ram will move to its retracted position because contacts RC6*b* and RC12*c* will be open. If the photodetecting means PE5 provides signal indicating a need for containers during the index cycle, the contacts PEC5 will open deenergizing relay R12 whereby contacts RC12*c* will close but with the contacts RC6*b* being open the ram will remain in its extended position preventing feeding. At the start of the dwell cycle, contacts RC6*b* will close and with the contacts RC12*c* being closed, the solenoid SOL 3 will be energized permitting feeding of the containers.

In the control of the operations at the orienting station, current is supplied to control means from a transformer T2. Since the control means for each of the rotating platforms 45 and of the sealant dispensing nozzles 59 and 60 is the same, in the illustrated structure, only one control means is described herein. Current from the transformer T2 is supplied to a suitable rectifier power supply PS1 which converts the AC current to DC current. The power supply PS1 can be of any suitable type providing the proper voltage and current. A preferred unit is sold by Electronic Counters and Controls, Inc., of Mundelein, Ill. Power supply PS1 supplies current to a DC servocontrol SC-1. The servocontrol SC-1 controls speed of the motor 40 by tachometer feedback from the encoder 41. A suitable servocontrol is a Model PA302 Amplifier modified per E31289 sold by Torque System, Inc. of Waltham, Mass. The servocontrol SC-1 is also electrically connected to a platform position control means PC1 such as Model CB135SP Counter Controller manufactured by Electronic Counters and Controls, Inc. (ECCI), of Mundelein, Ill. A tachometer encoder E1 is operably connected to the position controller PC1 and provides a signal representative of the number of rotations by degrees of the shaft of the motor 40 to the position controller PC1. A photoelectric transducer such as a photoelectric eye PE1 is operably connected to the power supply of transformer T2 and is operable for providing a signal to the position controller PC1 to indicate the when a mark on the container makes a circuit in the photoelectric eye PE1. In operation, the position controller PC1 has three counters for controlling the operation of the orienting station. The vacuum switch VS 50 closes when a predetermined level of vacuum is reached signalling the presence of a can on the platform 45. In the dwell cycle cam switch CS3 is closed and, during dwell, when the cam switch CS4 is in the up position of the schematic relay R5 in line 10 is energized closing relay contacts RC5. With RC5 closed and vacuum switch VS50 closed, the motor 40 begins turning and accelerating to a predetermined maximum RPM, preferably about 1,000 RPM. Closing of the contacts RC5 and the vacuum switch VS50, resets the three counters in the position controller PC1 to preset values. Internally of the position controller PC1, there is a time delay timer which provides a preset time period, for example, 50 milliseconds, to allow the motor 40 to reach approximately maximum RPM before the position controller PC1 acts on signals from the encoder EC1 and eye PE1. After the preset time period, a signal from the eye PE1 indicates the passing of the mark on a container 6. Also, pulses from the encoder E1, which preferably are 360 per revolution multiplied by two by the position controller PC1 to indicate one-half degree increments are also transmitted to the position controller PC1. When the signal from the eye PE1 is received, the position controller PC1 internally sets itself to start down counting pulses from the encoder EC1 from the established point to 0. The position controller includes three timers or counters, T11, T12 and T13. Timer T11 sets the length of run of the motor 40 for the total number of revolutions by degrees before the motor 40 is stopped when the counter zeros out. Timer TI2 provides a time delay after the start of the receipt of the signal from the eye PE1 and the start of receipt of pulse signals from the encoder E1 at which the respective nozzle 59 or 60 will begin dispensing sealant by upcounting from 0 pulses or degrees to a set point. The timer TI3 is preset for an up count in degrees or pulses which will provide a timing of the total number of revolutions that the nozzle will dispense sealant into the respective container before the sealant dispensing is terminated. At the timing out of the counter TI3, dispensing of sealant will be terminated. Accordingly, the timer TI3 is operably connected to its respective valves 61 which preferably are solenoid controlled by SOL 9 and SOL 10. Preferably, the timer TI1 is set for 3612 pulses, timer TI2 is set for 10 degrees and timer TI3 is set for 1440 degrees. When the platform 45 and its container 6 reaches a rotational position at a preset number of degrees of rotation before the desired position for stopping the containers at the desired oriented rotational position, a ramped declining voltage or a reverse current is applied to the motor 40 to start deceleration. Deceleration occurs for a precise number of degrees and rotation is terminated at the desired rotational position within one pulse of the position controller PC1 which is described above would be one-half pulse of the encoder EC1.

Before the start of the rotation of the motors 40, the cam switch CS4 of the cam unit 155 is in the down position as seen in the drawing thereby energizing the solenoid SOL 11 of a valve in the air line to the ram 54. When energized, the solenoid SOL 11 operates the valve to supply air to the back side of the ram 54 so that the ram 54 will extend and move the tamper 52 downwardly to insure contact between the bottom of a container 6 and its respective platform 45. After a predetermined time period, the cam switch CS4 moves to its up position thereby deenergizing solenoid SOL 11 to supply air to the rod side of the ram 54 to force the ram to retract and move the tamper 52 out of engagement with the containers 6.

After the containers have been located, the grippers 20 and 21 grip the containers and the turret 8 is indexed to move the oriented containers 6 to the side seaming station so that sealant can be applied to the side seam.

Application of sealant is accomplished during dwell of the apparatus 1. During dwell cam switch CS1 of cam unit 155 is in the down position supplying current to relay contacts RC2, RC3 and RC4. RC2 is normally open and is not closed until either of RC3 and RC4 are closed. RC3 and RC4 are normally closed contacts and are operated by relays R3 and R4, respectively, which are operably connected to photoelectric transducer means such as photoelectric eyes PE3 and PE4, respectively. The eyes PE3 and PE4 are operable for transmitting and receiving light reflected from a reflector 38 (as seen in FIG. 2) positioned preferably at a position below the turret 8 and indicate the presence or non-presence of a container 6 at each of the side seaming stations. If a container is present, its respective relay R3 or R4 will pass current through a toggle switch TS6 if closed. This is a manually operated switch which selectively permits functioning of the side seaming stations. If the relay contacts RC10 are closed, then current is supplied to a cam switch CS2 of the cam unit 155 which in the dwell cycle is closed. Accordingly, if a container 6 is present at either of the side seaming locations, current is supplied to solenoid SOL 1 of a 4-way valve in the air lane which controls the operation of the ram 79. When energized the solenoid SOL 1 actuates the ram 79 to move downwardly to effect downward movement of the wands 82. Also, relay 2 is energized and has contacts RC2 which latches the relay to maintain the relay 2 contacts closed and the relay R2 energized, if limit switch LS5 is closed. This maintains energization of the solenoid SOL 1. When the ram 79 contacts the limit switch L55 to deenergize and open the contacts RC2. When the limit switch LS5 is opened, solenoid SOL 1 is deenergized causing the ram 79 to retract, preferably at a control rate as controlled by a flow control valve (not shown).

Relay R10 has contacts RC10*a* located in the line for energizing solenoid SOL 1. When relay R10 is energized, contacts RC10*a* are closed so that current can be supplied for energizing solenoid SOL 1. Relay R10 is energized only during operation of the motor for driving the turret 8. Energization of R10 is accomplished by contacts RC9 which are closed by relay R9 located in the overload protector 157. The RC10 contacts will be closed only during operation of the turret motor of the indexer and therefore no accidental injury or harm will occur to the operator while working within the side seam area by having the cylinder 79 accidentally extend by the presence of a hand, etc., in front of either of the photoelectric eyes PE3 or PE4. Just before starting of the indexing movement of the turret 8, the cam switch CS1 shifts to the upper position supplying current to limit switch LS1 and to relay R1. By breaking the circuit 2, solenoid SOL 1 just before the indexing movement of the turret, it is assured that the ram 79 will be moved to the retracted position irrespective of the remainder of the controls for energizing solenoid SOL 1. If the ram 79 is not returned to its retracted or up position by the time cam switch CS1 is switched to its up position, then limit switch LS1 will still be closed allowing relay 1 to be energized. Contacts RC1 are provided for controlling the controller 156 to provide an emergency stop to prevent cycling of the turret 8 in the event the wand and the ram 79 have not moved to the retracted position.

In the event of an overload condition for rotation of the turret 8, either of the push-buttons PB3 or PB3 is pressed manually which will unlatch relay R10 thereby opening the contacts RC10 which effect energization of the solenoid SOL 1 which will prevent the ram 79 from extending.

Spraying of sealant from the nozzles 81 is started by energization of solenoids SOL 7 and SOL 8. This is accomplished by use of a timer TI4 which is used for energizing two solenoid valves, one to each sealant dispensing nozzle 81, i.e., at the side seaming stations. Limit switch LS2 is located about halfway down the support 76 and is actuated by the presence or passage of the ram 79 during its extension stroke. When the relay R2 is energized when the ram 79 reaches its furthermost extended position, contacts RC2*a* are closed. Also, during the dwell cycle, cam switch CS3 is closed energizing relay R6 whereby contacts RC6*c* are also closed. Closure of the limit switch LS2 and contacts RC2*a* will energize solenoids SOL 7 and SOL 8 when a container is present at the respective dispensing station, for a preset time period as controlled by the timer T14 for dispensing sealant preferably during the downward movement of nozzles 81. For energization of the solenoids SOL 7 and SOL 8, the control as described above includes relay contacts RC3, RC4 and RC6*c* which must be closed for energization of the solenoids SOL 7 and SOL 8. Closure of relay contacts RC3 and RC4 is through energization of relay R3 and R4 when a container's presence is sensed by PE3 or PE4. If toggle switches TS4, TS2 and TS3 are closed then the push-buttons PB8, PB9 and PB10 are used as manual overrides to energize SOL 7, SOL8, SOL9 and SOL 10 and effect purging of the bottoms spray and side spray sealant supply systems. The solenoids SOL 7 and SOL 8 are deenergized by the timer T14 timing out to terminate dispensing of sealant when the wand has reached a predetermined down position. The sealant dispensed by the wand 82 at the lower end of its movement overlaps the sealant at the junction of the bottom and sidewall of the container. When cam switch CS3 is closed, relay R14 is energized closing contacts RC14A and RC14B which permits energization of the relays R3 and R4 allowing the photoelectric eyes PE3 and PE4 to function as described above.

When the cam switch CS3 is closed during the dwell cycle, solenoid SOL 4, of a 4-way valve in the air line to ram 36, solenoid SOL 5 of a 4-way valve in the air line to ram 49 and solenoid SOL 6 of a 4-way valve in the air line to ram 108 are energized. Solenoid SOL 4 controls operation of the ram 36 which during the dwell cycle moves the grippers at the tamping station to their non-gripping position. When solenoid SOL 5 is energized, vacuum is applied to the passages 46 to retain the containers on the respective platform 45 during the dwell cycle. When solenoid SOL 6 is energized the ram 108 is moved to its extended position.

To effect operation of the vacuum pumps 48 push-button PB5 is closed energizing the vacuum pumps. A relay RVP is energized closing the contacts VPC1 to maintain current flowing to the vacuum pumps 48. To terminate operation of the vacuum pumps 48, the push-button PB12 is pushed, opening the circuit to the relay RVP deenergizing the relay thereby opening the contacts VPC. Further, if the vacuum pump is overloaded, the contacts of either overload switch 5 OL1 and/or OL2 are opened thereby breaking the circuit to the relay RVP.

The motor 134 which drives the wiping means 125 has its operation controlled by toggle switch TS5 which is operable for selectively allowing the motor 134 to run or terminating operation of the motor 134.

As described above, the conduits conducting sealant to the respective nozzles for dispensing has the temperature thereof controlled by a sealant control system such as a Nordson HMXII, manufactured by the Nordson Corp., Amherst, Ohio. The temperature controller TC1 is also operable for controlling heaters in the respective solenoid valves SOL 7, SOL 8, SOL 9 and SOL 10. Further, temperature controller TC1 has operably connected thereto another temperature controller TC2 which is operable for controlling temperature of the sealant in the wands 82 by controlling operation of the heaters in the wands 82. In the illustrated structure temperature controller TC2 is a West Guardsman Temperature Controller with an operating range of 0°–600° F.

The heaters 119 can have the temperature adjusted by a voltage controller VC1. The higher the voltage the higher the temperature. Accordingly, an increase or decrease in the setting of the voltage controller VC1 will change the temperature of the heaters 119.

It is to be understood that while there has been illustrated and described certain forms of the present invention, it is not to be limited to the specific form or arrangement of parts herein described and shown except to the extent that such limitations or their equivalents are found in the claims.

What is claimed and desired to be secured by Letters Patent is:

1. An apparatus for wiping an exterior surface of a nozzle at an area adjacent a discharge opening, said apparatus including:

a support;

a carriage;

first means mounting the carriage on the support for reciprocal movement;

power means operably connected to the carriage for selectively effecting reciprocal movement of the carriage;

a hub;

second means rotatably mounting the hub on the carriage;

drive means operably connected to the second means operable for effecting rotation of the hub; and at least one wiper secured to said hub, said wiper being of a resilient material and projecting outwardly from the hub and being adapted for wiping material from a nozzle during rotation of the hub by having a surface of the wiper engage the nozzle.

2. An apparatus as set forth in claim 1 further comprising:

third means carried by the support and being operable for selectively engaging the surface of the wiper and for removing from the surface of the wiper at least a portion of the material wiped from the nozzle.

3. An apparatus as set forth in claim 2 wherein:

said third means forms a receptacle defining a chamber and has an edge for engaging the surface of the wiper and removing material from the wiper with the removed material being collected in the chamber.

4. An apparatus as set forth in claim 3 wherein:

said receptacle is in the form of an upwardly opening trough having an open end.

5. An apparatus as set forth in claim 3 wherein:

said drive means includes a motor mounted on the carriage for movement with the carriage and includes a drive member operably connecting the motor to the second means.

6. An apparatus as set forth in claim 5 wherein:

the second means includes a shaft having the hub mounted thereon, said shaft is rotatably mounted on the carriage.

7. An apparatus as set forth in claim 3 or 6 wherein:

said hub has a plurality of wipers secured thereto, said wipers being in spaced apart relation; and said receptacle is mounted on said carriage for movement with the carriage.

8. An apparatus as set forth in claim 7 wherein:

there is a plurality of said hubs each having a plurality of wipers secured thereto and each of said plurality of hubs being operable for wiping a respective nozzle; and there is a plurality of said third means each operable for engaging each said surface of a respective plurality of wipers secured to a respective hub.

9. An apparatus as set forth in claim 5 wherein said power means includes:

a selectively extendable and retractable ram mounted on the support; and a link and a pivot pivotally mounting the link on the support, said link having a first end portion on one side of the pivot operably connected to the ram whereby extension and retraction of the ram effects pivoting of the link, said link having a second end portion on the other side of the pivot operably connected to the carriage whereby pivoting movement of the link effects reciprocal movement of the carriage.

10. An apparatus for applying sealant to a seam in a container formed by overlapping portions of the sidewall, said apparatus including:

conveying means operable for moving a container to and away from a first sealing station;

first detecting means positioned adjacent to a portion of said conveying means and being operable for detecting the rotational position of a container sidewall;

first drive means positioned adjacent said first detecting means and being operable for selectively rotating a container to a predetermined rotational position;

first sealant dispensing means positioned adjacent said conveying means at the first sealing station and being operable for dispensing sealant onto at least a portion of said seam, said first sealant dispensing means cooperating with means for providing relative movement between a portion of the first sealant dispensing means and the container, said sealant dispensing means including a nozzle;

a support;

a carriage;

first means mounting the carriage on the support for reciprocal movement;

power means operably connected to the carriage for selectively effecting reciprocal movement of the carriage;

a hub;

second means rotatably mounting the hub on the carriage;

drive means operably connected to the second means operable for effecting rotation of the hub;

at least one wiper secured to said hub, said wiper being of a resilient material and projecting outwardly from the hub and being adapted for wiping material from a nozzle during rotation of the hub by having a surface of the wiper engage the nozzle; and third means carried by the support and being operable for selectively engaging the surface of the wiper and removing from the surface of the wiper at least a portion of the material wiped from the nozzle.

11. An apparatus as set forth in claim 10 wherein:

said third means forms a receptacle defining a chamber and has an edge for engaging the surface of the wiper and removing material from the wiper with the removed material being collected in the chamber.

12. An apparatus as set forth in claim 9 wherein:

said receptacle is in the form of an upwardly opening trough having an open end.

13. An apparatus as set forth in claim 9 wherein:

said drive means includes a motor mounted on the carriage for movement with the carriage and includes a drive member operably connecting the motor to the second means.

14. An apparatus as set forth in claim 13 wherein:

the second means includes a shaft having the hub mounted thereon, said shaft is rotatably mounted on the carriage.

15. An apparatus as set forth in claim 11 or 14 wherein:

said hub has a plurality of wipers secured thereto, said wipers being in spaced apart relation; and said receptacle is mounted on said carriage for movement with the carriage.

16. A method of removing liquid from an exterior surface of a nozzle, said method including:

moving a surface of a wiper blade on a rotatable hub into engagement with an exterior surface of a nozzle adjacent a discharge opening of the nozzle;

rotating the hub to move the surface of the thus engaged wiper blade relative to the exterior surface of the nozzle and transferring at least a portion of liquid on the nozzle to the surface of the wiper blade;

further rotating the hub to move the surface of the wiper blade out of engagement with the exterior surface of the nozzle; and further rotating the hub so that the surface of the wiper blade comes into contact with means for engaging the surface of the wiper blade to remove therefrom at least a portion of the liquid wiped from the nozzle thereby removing at least a portion of the liquid on the surface of the wiper blade therefrom.

17. A method as in claim 15 further comprising:

moving the surface of the wiper blade upwardly relative to the exterior surface of the nozzle and transferring substantially the entirety of liquid on the nozzle to the surface of the wiper blade.

18. A method as in claim 16 wherein:

the nozzle is mounted for vertical reciprocating movement between a first position and a second position; and further comprising:

removing liquid from the exterior surface of the nozzle in the first position.

19. A method of applying sealant to a seam in a container formed by overlapping portions of a sidewall, said method comprising:

moving a container to a first sealing station;

detecting the rotational position of the container sidewall of the thus moved container;

selectively rotating the container from the thus detected rotational position to a predetermined rotational position;

moving a sealant applying nozzle from a first position to a second position relative to the container at the thus predetermined position and dispensing sealant onto at least a portion of said seam;

moving the nozzle back to the first position;

moving a surface of a wiper into engagement with an exterior surface of the nozzle adjacent a discharge opening of the nozzle when said nozzle is in said first position;

moving the surface of the wiper relative to the exterior surface of the nozzle and transferring at least a portion of liquid on the nozzle to the surface of the wiper; and moving the surface of the wiper out of engagement with the exterior surface of the nozzle.

20. A method as in claim 19 further comprising:

removing from the surface of the wiper at least a portion of the liquid wiped from the surface of the nozzle.

21. A method as in claim 19 further comprising:

moving the surface of the wiper upwardly relative to the exterior surface of the nozzle and transferring substantially the entirety of liquid on the nozzle to the surface of the wiper.

* * * * *

UNITED STATES PATENT AND TRADEMARK OFFICE

CERTIFICATE OF CORRECTION

PATENT NO. : 4,259,372

DATED : March 31, 1981

INVENTOR(S) : William R. Eddy

It is certified that error appears in the above-identified patent and that said Letters Patent are hereby corrected as shown below:

Column 19, line 41, "5" should read --- 7 ---.
Column 20, lines 36 and 39, "9" should read --- 11 ---.
Column 21, line 6, "15" should read --- 16 ---.

Signed and Sealed this

*Twenty-first* Day of *July 1981*

[SEAL]

*Attest:*

GERALD J. MOSSINGHOFF

*Attesting Officer*

*Commissioner of Patents and Trademarks*